US006913488B2

(12) United States Patent
Motojima et al.

(10) Patent No.: US 6,913,488 B2
(45) Date of Patent: Jul. 5, 2005

(54) ELECTRICAL CONNECTOR

(75) Inventors: Yuko Motojima, Tokyo (JP); Takushi Yoshida, Tokyo (JP); Hiroshi Akimoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/712,339

(22) Filed: Nov. 14, 2003

(65) Prior Publication Data

US 2004/0097107 A1 May 20, 2004

(30) Foreign Application Priority Data

Nov. 14, 2002 (JP) ..... 2002-331045

(51) Int. Cl.[7] ..... H01R 13/648
(52) U.S. Cl. ..... 439/607; 439/79; 439/571
(58) Field of Search ..... 439/79, 607–610, 439/571

(56) References Cited

U.S. PATENT DOCUMENTS

| | | | | |
|---|---|---|---|---|
| 6,354,886 | B1 | 3/2002 | Yu | |
| 6,537,086 | B1 * | 3/2003 | Mac Mullin | 439/79 |
| 6,619,986 | B1 * | 9/2003 | Yeh | 439/607 |
| 6,767,251 | B2 * | 7/2004 | Yu et al. | 439/607 |

FOREIGN PATENT DOCUMENTS

| | | |
|---|---|---|
| DE | 19909847 | 9/2000 |
| EP | 0729206 | 8/1996 |
| JP | 05228956 | 9/1993 |
| JP | 5228956 | 9/1993 |
| JP | 682771 | 11/1994 |
| JP | 11111421 | 4/1999 |
| JP | 2000067988 | 3/2000 |
| JP | 2000164283 | 6/2000 |
| JP | 200188173 | 4/2001 |
| JP | 2001088173 | 4/2001 |
| JP | 20011336611 | 12/2001 |

* cited by examiner

*Primary Examiner*—Truc Nguyen
(74) *Attorney, Agent, or Firm*—Baker Botts L.L.P.

(57) ABSTRACT

An insulator used in an electrical connector has a plate like portion. The plate like portion has upper and lower surfaces perpendicular to a Z-direction and is elongated in an X-direction. In the lower surface, a plurality of grooves are formed and extend in parallel with each other in a Y-direction. The grooves are arranged with intervals in the X-direction so that a plurality of ridges is formed between the respective neighboring grooves in the X-direction. In the upper surface of the plate like portion, material-depressed portions are provided. Each material-depressed portion extends in the Y-direction and has a shape longer in the Y-direction than in the X-direction. Each material-depressed portion is positioned in correspondence with one of the ridges. The insulator is made of anisotropic resin.

14 Claims, 34 Drawing Sheets

ELECTRICAL CONNECTOR

The present application claims priority to prior Japanese application JP 331045/2002, the disclosure of which is incorporated herein by reference.

BACKGROUND OF THE INVENTION

This invention relates to an electrical connector and, in particular, to an insulator in the electrical connector. The term "electrical connector" is merely referred to as "connector", hereinafter.

A known connector has an insulator, which comprises a holding portion for holding contact pins and a plate like portion formed integral with the holding portion. The plate like portion has inner and outer surfaces perpendicular to a first direction and is elongated in a second direction perpendicular to the first direction. The plate like portion is provided with a plurality of grooves, which are formed in the inner surface of the plate like portion. Each groove extends in a third direction perpendicular to the first and the second directions. The grooves are arranged in the second direction so that ridges are formed between the respective neighboring grooves in the second direction. In other words, the plate like portion has a cross section of square waves in a plane perpendicular to the third direction. The inner surface of the plate like portion faces the contact pins under the assembled state of the connector, and the grooves are positioned in correspondence with the respective contact pins held by the insulator.

An insulator having a complex shape as mentioned above is formed by an injection molding process, wherein anisotropic resin such as liquid crystal polymer is used as material of the insulator. The liquid crystal polymer is excellent in heat resistance and also has a property difficult to vary with time. On the other hand, because of its anisotropy, the liquid crystal polymer expands or contracts upon high temperature heating or cooling in accordance with alignment of the material.

There is one problem that an undesirable curve occurs at a molded insulator.

Because of the square-waves cross-section of the insulator, there is a large difference between expansion/contraction coefficients on the inner and the outer surfaces of the plate like portion. The expansion/contraction coefficient difference causes the undesirable curve of the insulator.

In addition, because of the elongated shape of the plate like portion, it is often difficult for resin to flow into a metal mold smoothly upon injection molding. As a result, residual stress might occur in the molded insulator. Such residual stress also causes the undesirable curve of the insulator.

SUMMARY OF THE INVENTION

It is an object of the present invention to provide a connector having an insulator, wherein undesirable curves of the insulator are reduced.

The present invention is applicable to an electrical connector comprising an insulator and a plurality of contact pins held by the insulator. According to the present invention, the insulator comprises a base portion elongated in a first direction and having a thickness in a second direction perpendicular to the first direction and a height in a third direction perpendicular to the first and second directions. The insulator further comprises a plate like portion, the plate like portion extending in the second direction from a top end of the base portion in the third direction and having first and second surfaces opposite to each other in the third direction. The plate like portion has a plurality of grooves formed in the first surface, the grooves extending in parallel with each other in the second direction and being spaced from each other in the first direction so that a plurality of ridges are formed between the respective neighboring ones of the grooves in the first direction. The contact pins are supported by the base portion and extend in the second direction along the grooves, respectively. The insulator is provided with a pattern on the second surface. The pattern comprises at least one depressed portion formed in the second surface and/or at least one raised portion formed on the second surface.

Preferred developments of the invention will be clarified below as the description proceeds.

DESCRIPTION OF PREFERRED EMBODIMENTS

Figure 1:
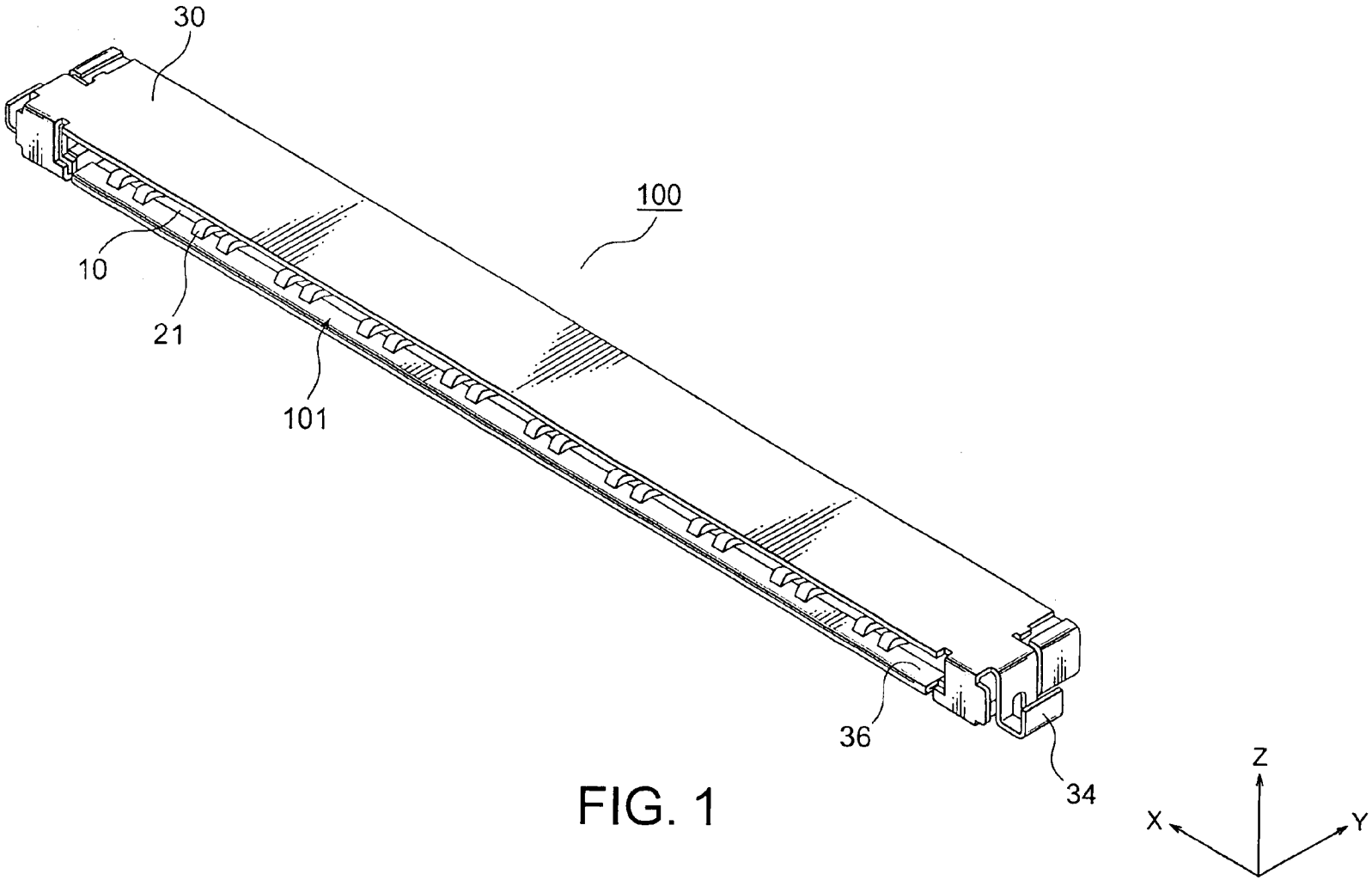
FIG. 1 is a perspective view showing a connector according to a first embodiment of the present invention.
Figure 2:
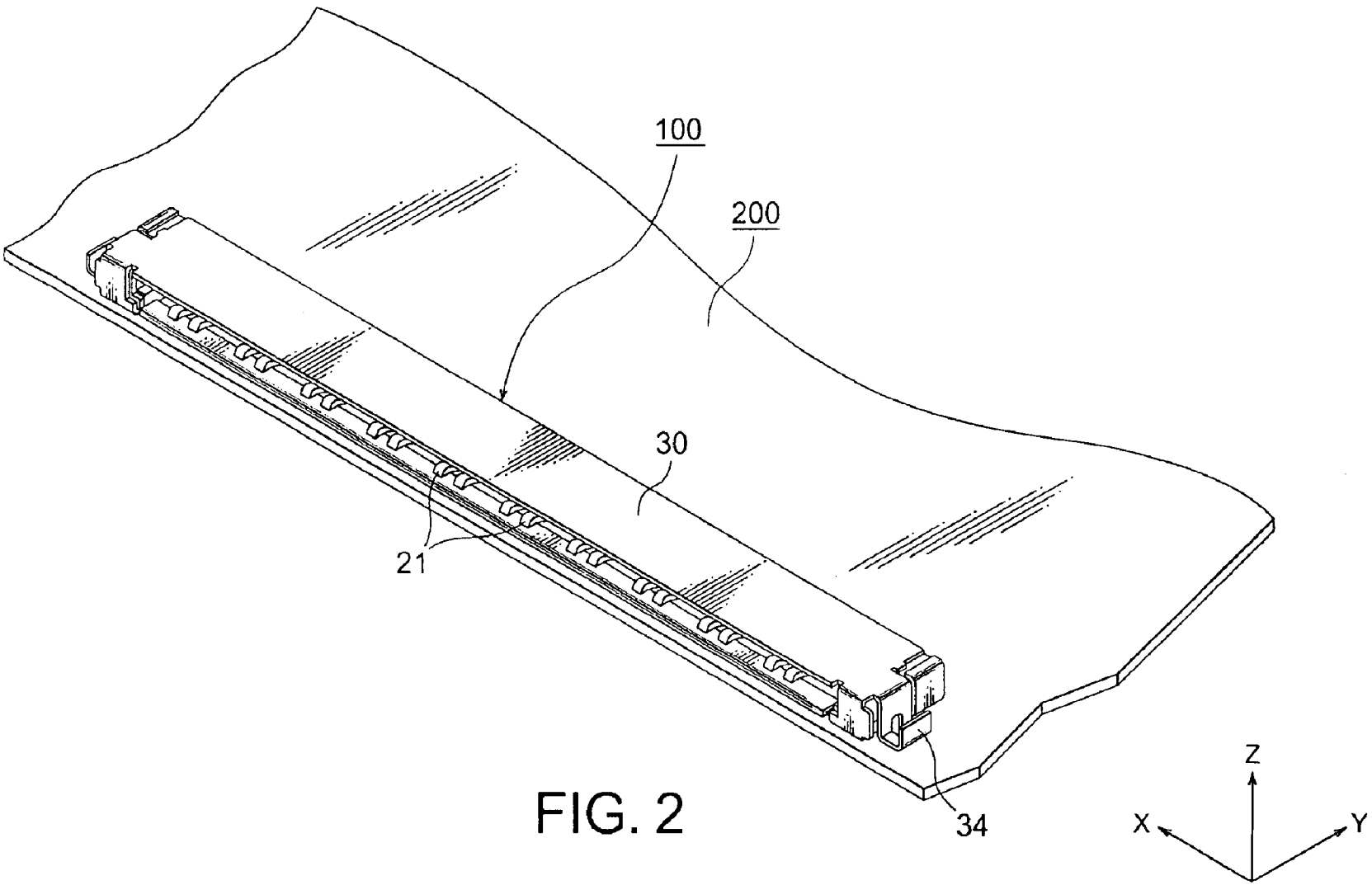
FIG. 2 is a perspective view showing the connector of FIG. 1, which is mounted on a circuit board.
Figure 3:
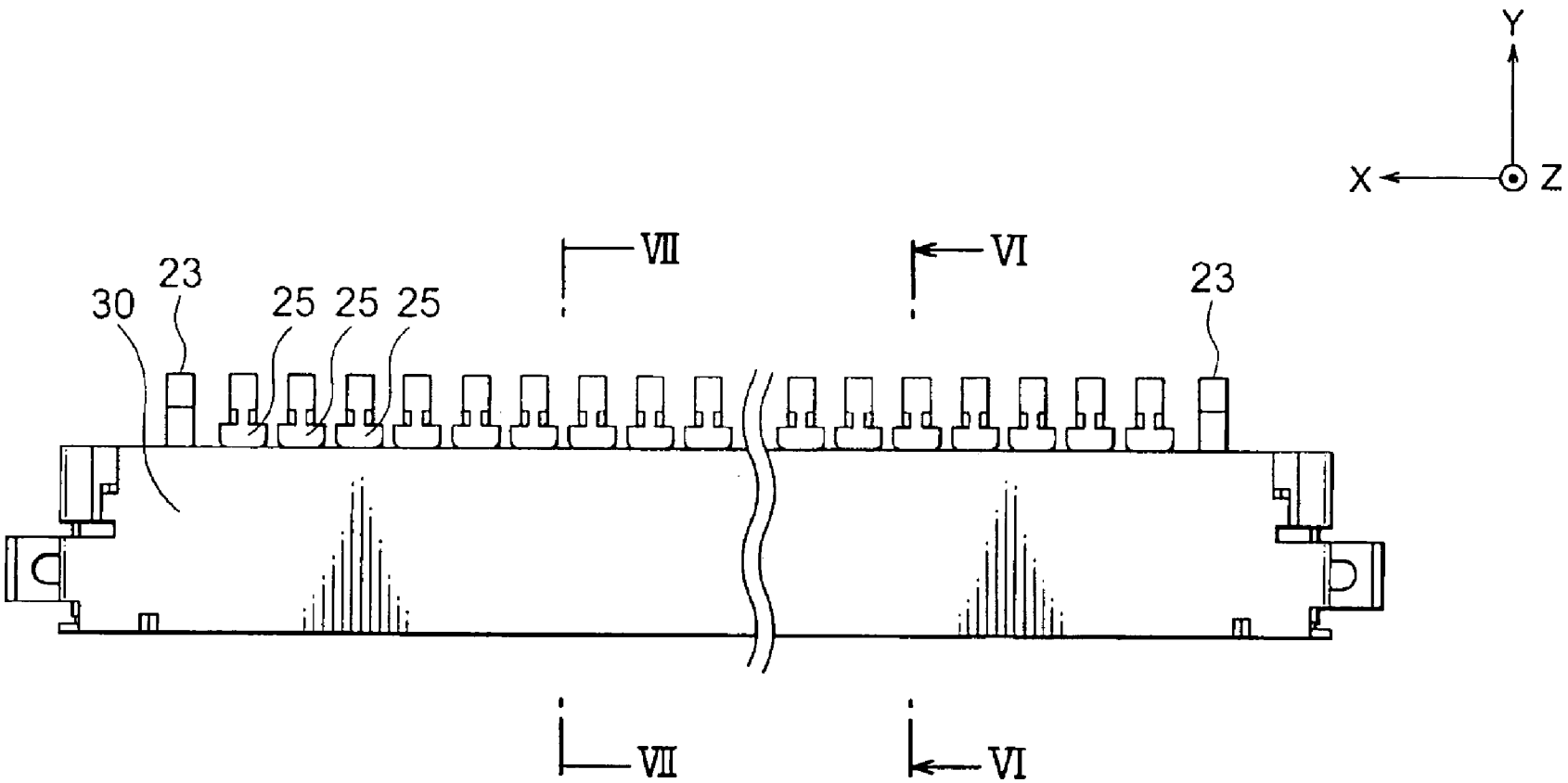
FIG. 3 is a top plan view showing the connector of FIG. 1.
Figure 4:
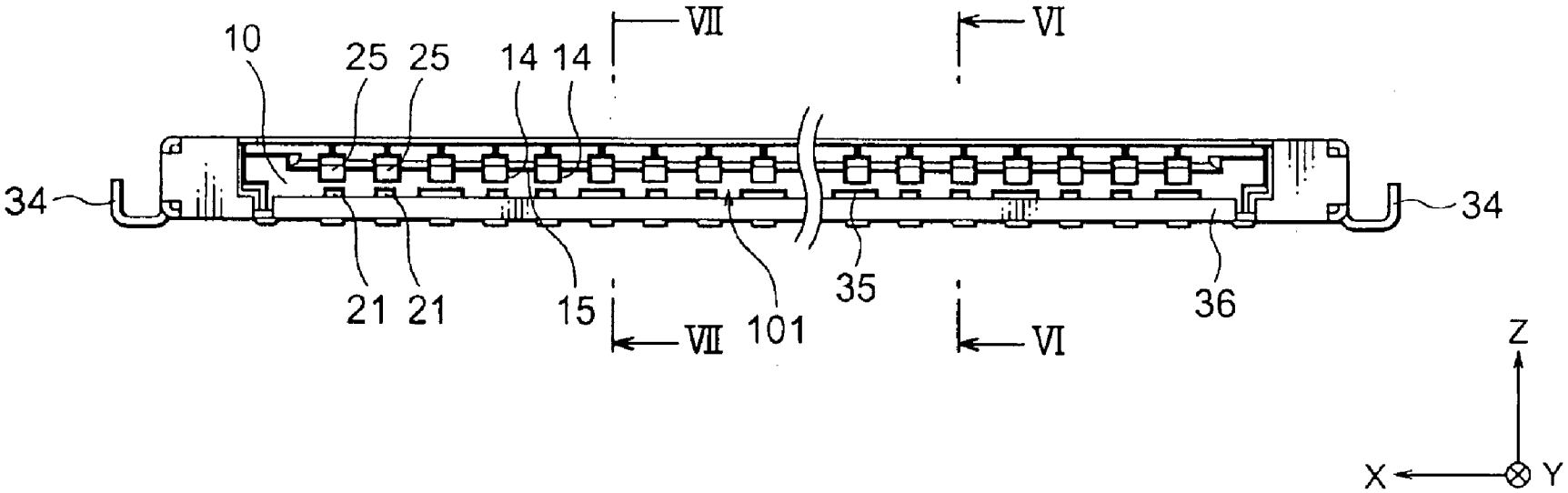
FIG. 4 is a front view showing the connector of FIG. 1.
Figure 5:
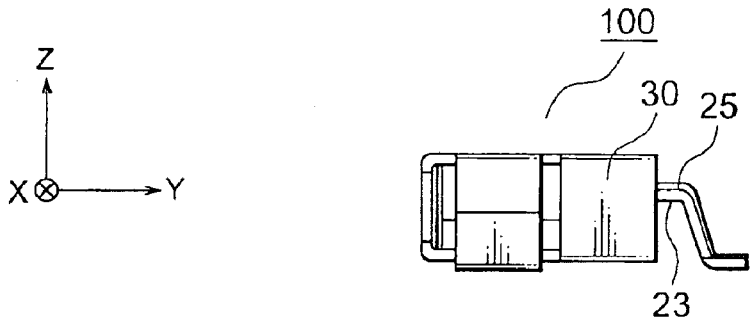
FIG. 5 is a side view showing the connector of FIG. 1.

With reference to FIGS. 1 to 10, a connector 100 according to a first embodiment of the present invention comprises an insulator 10, a ground plate 20 having a plurality of ground contact pins 21, a plurality of signal contact pins 25, and a shell 30. The connector 100 of this embodiment is a receptacle connector, which is mounted on a circuit board 200, as shown in FIG. 2, within an electronic instrument such as an LCD (liquid crystal display). The connector can be mounted on a substrate within the electronic instrument. The connector 100 is connectable to a connector connected to an FPC (flexible printed circuit) or a connector connected to cables.

Figure 6:
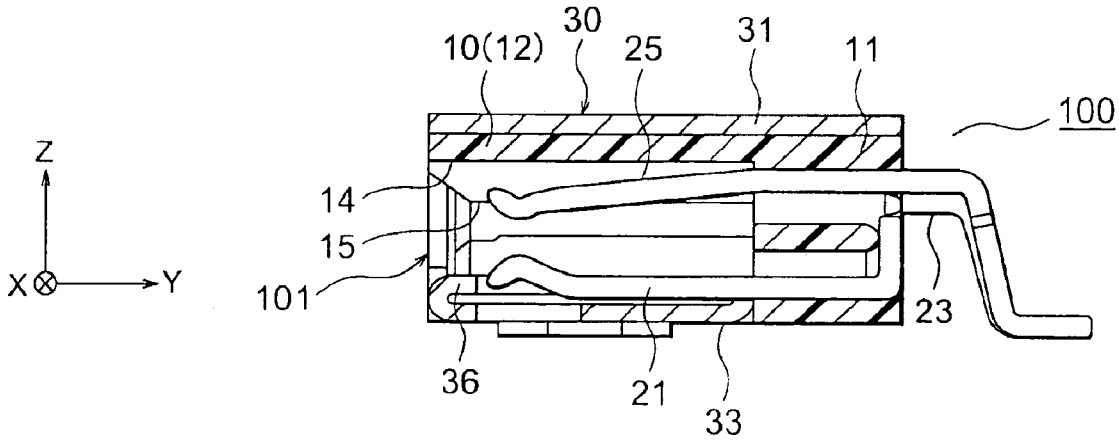
FIG. 6 is a cross-sectional view showing the connector of FIG. 3 or 4, taken along lines VI—VI.
Figure 7:
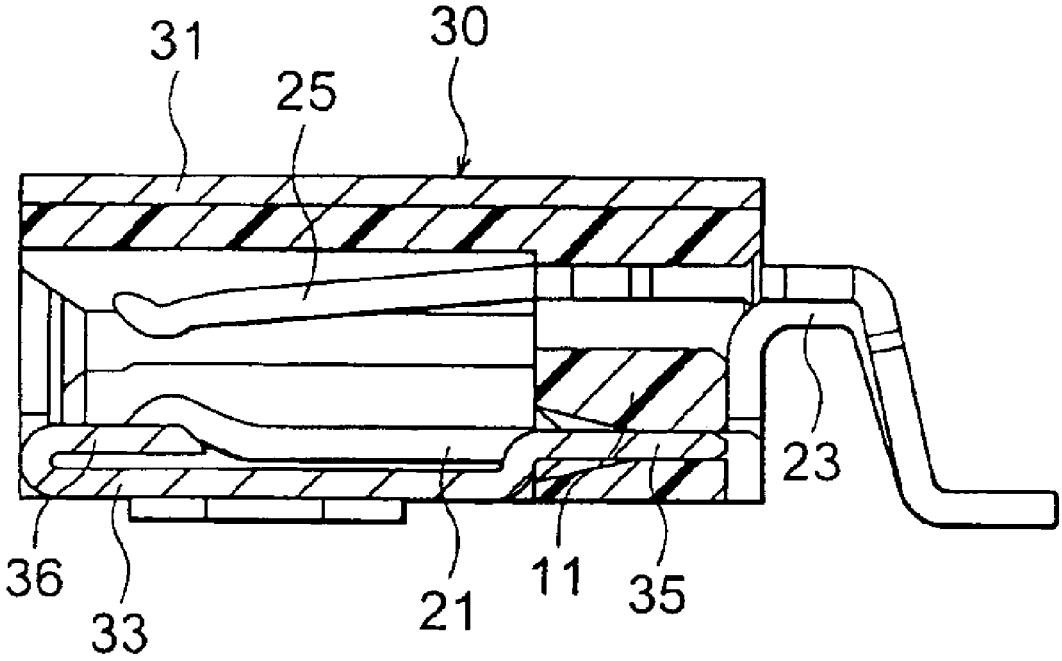
FIG. 7 is a cross-sectional view showing the connector of FIG. 3 or 4, taken along lines VII—VII.

The connector 100 has an open end 101 in a Y-direction. The open end 101 can receive a fitting portion of a mating connector (not shown) when the connector 100 is mated with the mating connector. The ground contact pins 21 and the signal contact pins 25 are held by the insulator 10, as best shown in FIGS. 6 and 7, so that the contact pins 21, 25 can be touched or accessed through the open end 101. The signal contact pins 25 are same with each other in the shape and arranged at regular intervals in the X-direction. The ground contact pins 21 are arranged at regular intervals in an X-direction perpendicular to the Y-direction. The shell 30 covers the insulator 10 for the sake of electrical noise shielding or the like.

Figure 8:
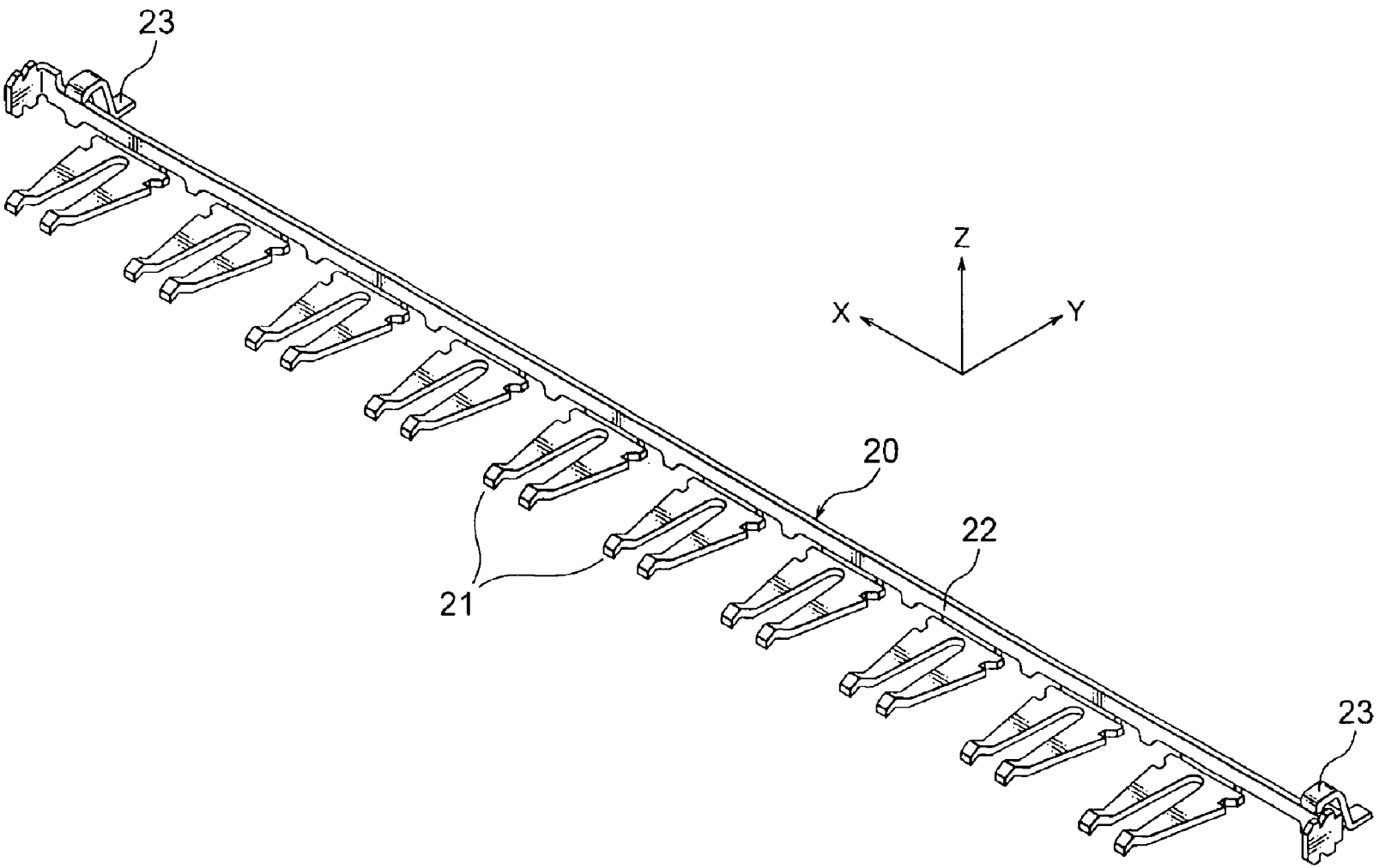
FIG. 8 is a perspective view of a ground plate.

Referring to FIG. 8, the ground plate 20 comprises a common plate 22 elongated in the X direction, ground pins 21 projecting from the common plate 22 and two ground terminals 23 projecting from opposite end portions of the common plate 22. The ground terminals 23 extend in the Y direction but opposite to the ground pins 21.

Figure 9:
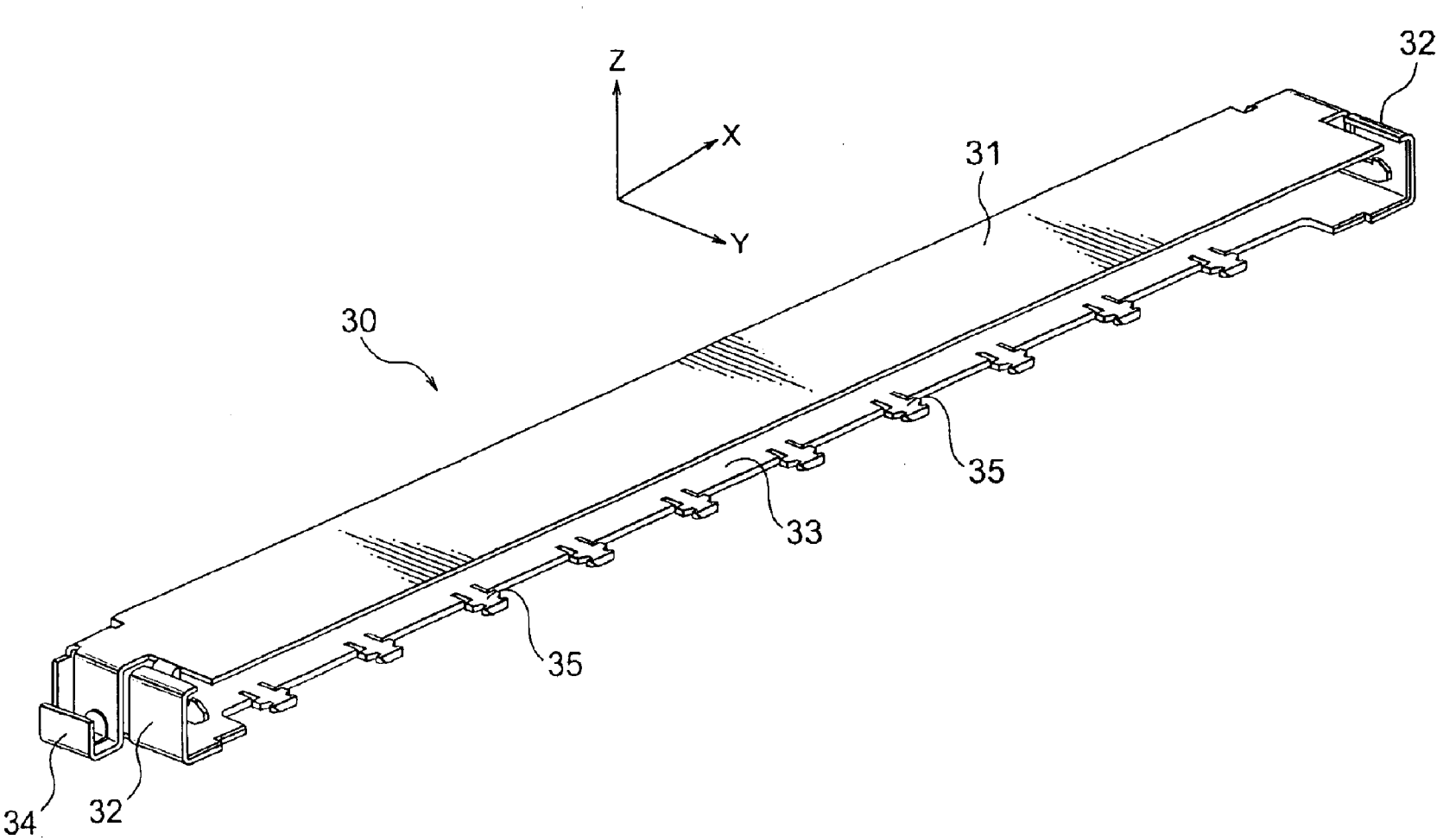
FIG. 9 is a perspective view of a shell.
Figure 10:
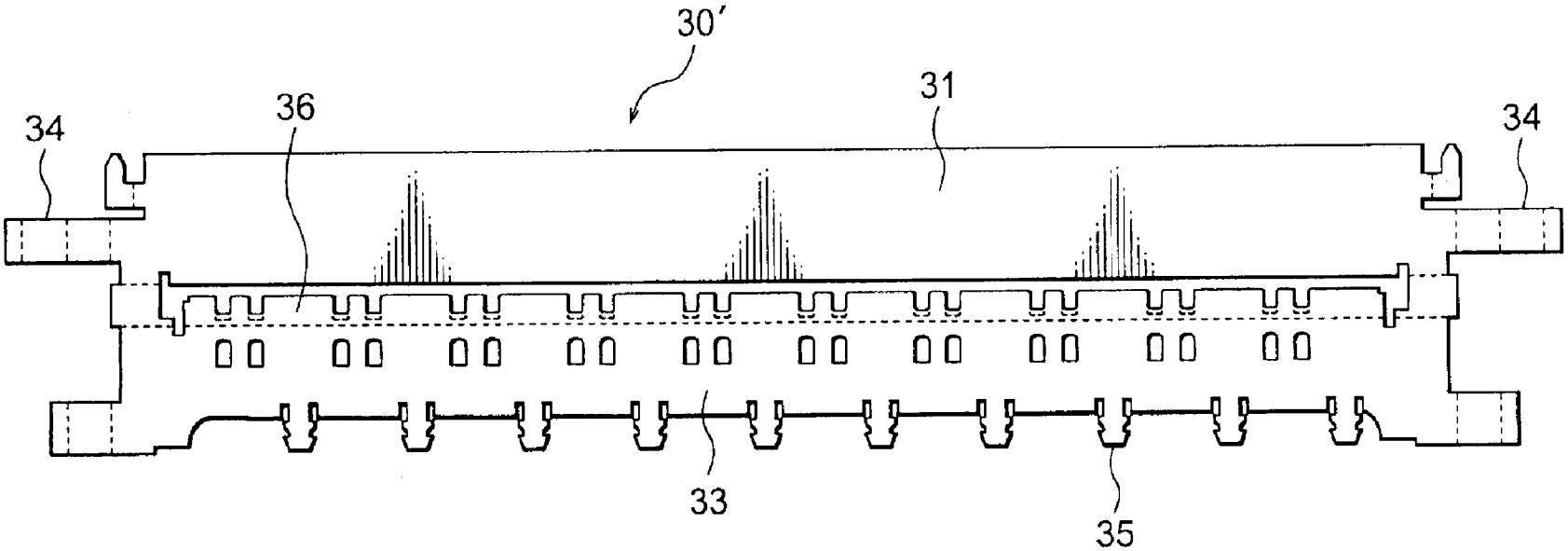
FIG. 10 is a development of the shell shown in FIG. 9.

Referring to FIGS. 9 and 10, the shell 30 is a rectangular tubular metallic member and comprises a top portion 31, opposite side portions 32, and a lower portion 33. The shell 30 is further provided with two fixture portions 34 formed on the side portions 32 for fixing the connector 100 to the circuit board 200, and a plurality of engagement portions 35 projecting from the lower portion 33 for engaging with a base portion (11 in FIGS. 6 and 7). The shell 30 is made of a metal plate by punching to form a metal blank 30' shown in FIG. 10, which blank 30' is then subjected to bending processes to bend along dotted lines shown in the figure to form the shell 30. In FIG. 10, same portions are shown by the same reference numerals as in FIG. 9. A front end portion of the lower portion 33 in Y direction is bent inwardly as a folded portion 36 as shown in FIGS. 6 and 7.

With reference to FIGS. 11 to 16, the insulator 10 is comprised of a base portion 11, a plate like portion 12, and side portions or blocks 13, which are formed integral with each other by an injection molding process using a liquid crystal polymer as a material. As seen from FIGS. 6, 13, and 15, the base portion 11 supports the ground plate 20 with ground contact pins 21 and the signals contact pins 25, as mentioned above. The plate like portion 12 is connected to the base portion in a Z-direction perpendicular to the X- and the Y-directions. The side portions 13 are connected to the opposite sides of the plate like portion 12 in the X-direction, as shown in FIGS. 11 to 14. The plate like portion 12 and the side portions 13 form a rectangular U-like shaped cross-section in a plane perpendicular to the Y-direction, i.e., in the XZ plane.

Referring to FIGS. 1, 3, 4–5, and 7, the shell 30 is fit onto the insulator 10 so that the upper portion 31 overlying the upper surface of the plate like portion 12, the side portions 32 overlying outer surfaces of the side blocks 13 and the lower portion 33 extending between the side portions 13. The lower portion 33 facing the lower surface of the plate like portion 12 but being spaced therefrom also from the signal contact pins 25. The ground contact pins 21 extend along the lower portion 33 of the shell 30.

Figure 11:
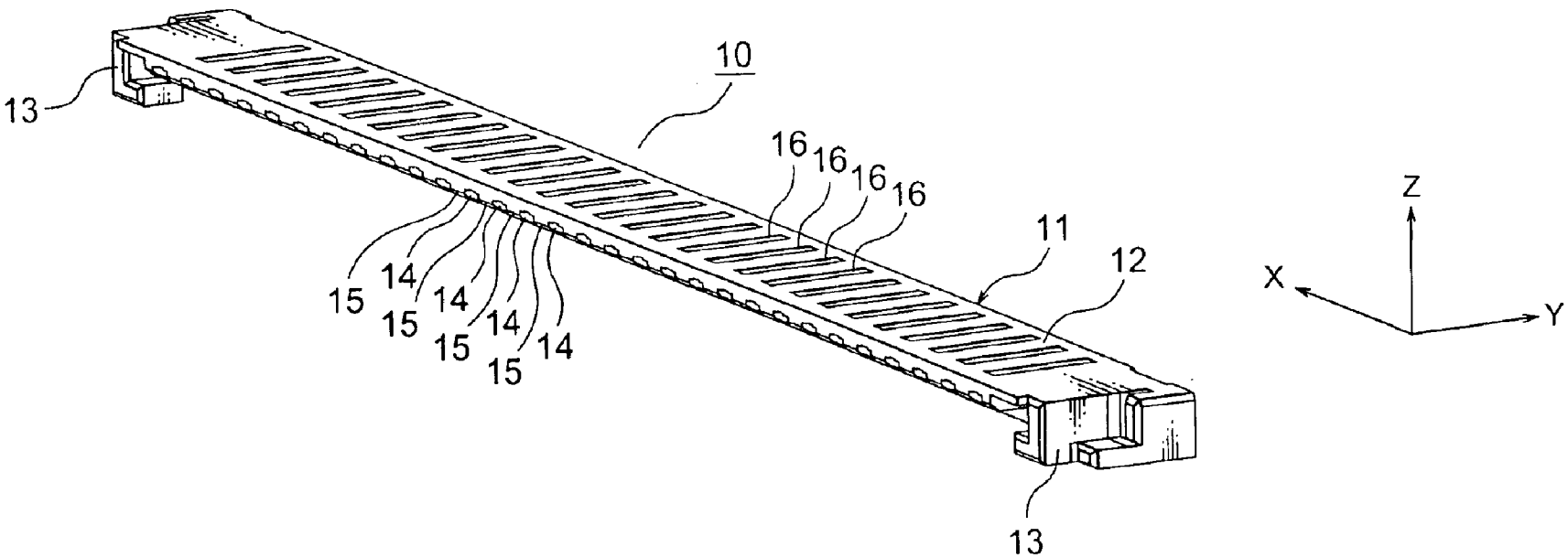
FIG. 11 is a perspective view showing an insulator included in the connector of FIG. 1.
Figure 12:
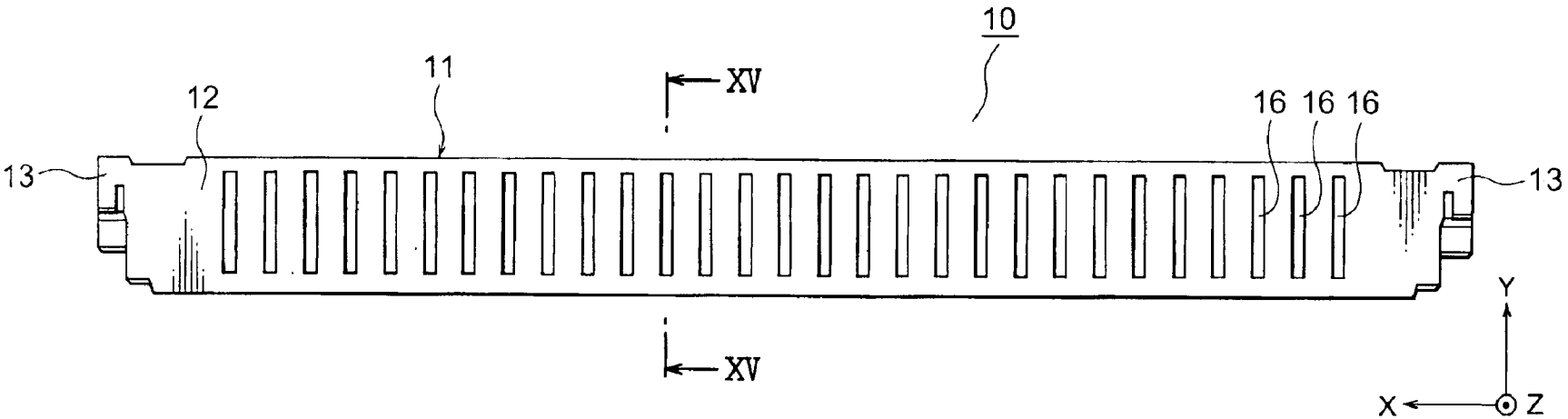
FIG. 12 is a top plan view showing the insulator of FIG. 11.
Figure 13:
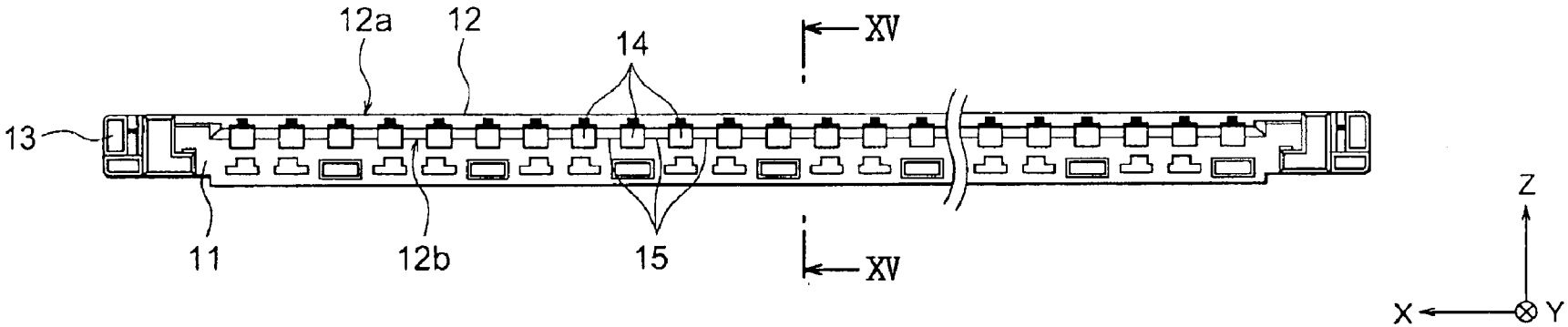
FIG. 13 is a front view showing the insulator of FIG. 11.
Figure 14:
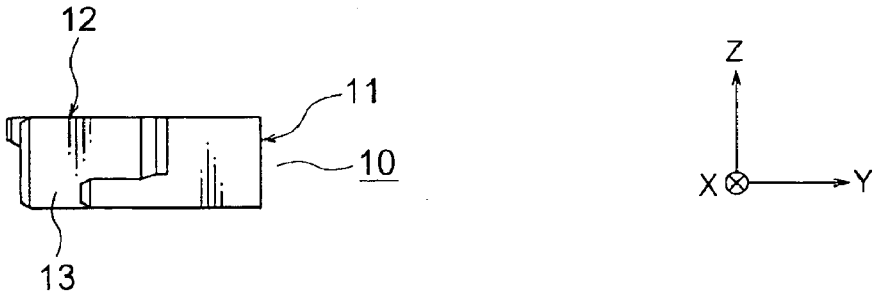
FIG. 14 is a side view showing the insulator of FIG. 11.
Figure 15:
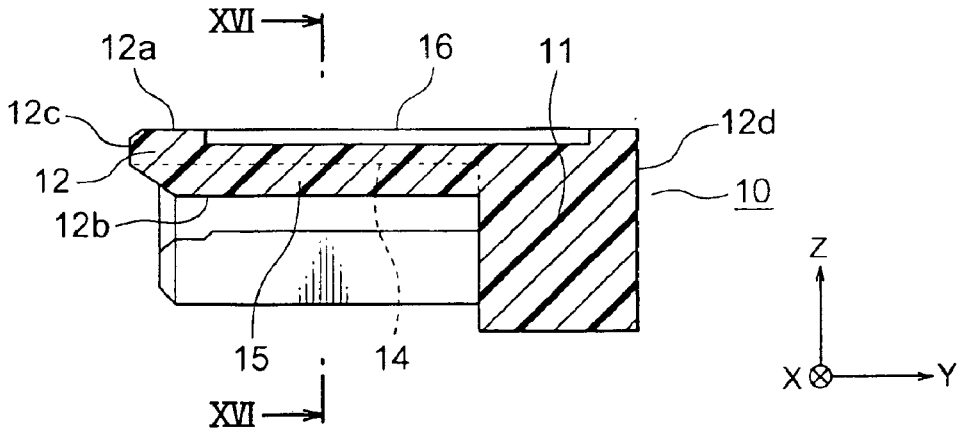
FIG. 15 is a cross-sectional view showing the insulator of FIG. 12 or 13, taken along lines XV—XV.

As shown in FIG. 15, the plate like portion 12 has upper and lower surfaces 12*a*, 12*b* in the Z-direction. In this embodiment, the upper and the lower surfaces 12*a*, 12*b* are substantially perpendicular to the Z-direction so that the plate like portion 12 has generally a flat plate like shape, as seen from FIG. 11. As shown in FIGS. 11 to 13, the plate like portion 12 is elongated in the X-direction.

Figure 16:
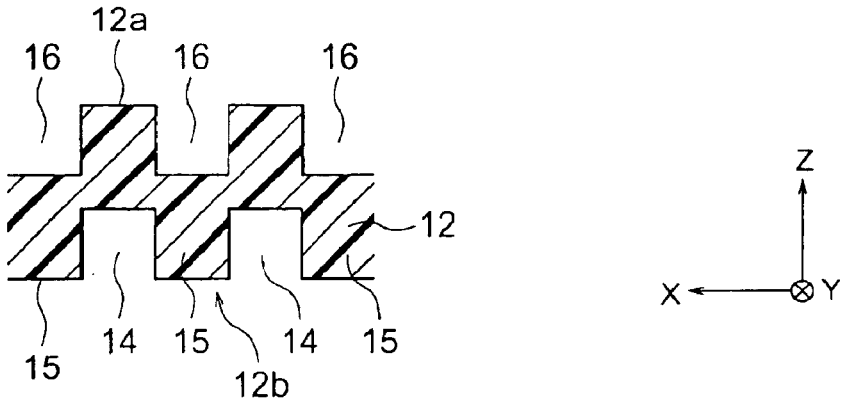
FIG. 16 is a cross-sectional view schematically showing a plate like portion of the insulator of FIG. 15, taken along lines XVI—XVI.

As shown in FIGS. 11, 13 and 16, a plurality of grooves 14 is formed in the lower surface 12*b* of the plate like portion 12. Each of the grooves 14 extends and is elongated in the Y-direction. The grooves 14 are arranged in the X-direction so that ridges 15 are formed between the respective neighboring grooves 14 in the X-direction. The grooves 14 and the ridges 15 form a cross section of continuous square waves, as shown in FIGS. 13 and 16.

As shown in FIGS. 11, 12, 15 and 16, the insulator 10 according to the present embodiment is further provided with a plurality of material-depressed portions 16 in the upper surface 12*a* of the plate like portion 12. Each of the material-depressed portions 16 is a rectangular recess extending in the Y-direction, as best shown in FIG. 12. In other words, each of the material-depressed portions 16 is elongated in the Y-direction and has a shape longer in the Y-direction than in the X-direction. In this embodiment, each of the material-depressed portions 16 has a constant depth, as shown in FIG. 15. In addition, each of the material-depressed portions 16 does not reach front and rear edges 12*c*, 12*d* of the plate like portion 12 in the Y-direction.

The material-depressed portions 16 are positioned in correspondence with the respective ridges 15, as best shown in FIGS. 15 and 16. The material-depressed portions 16 are arranged in the X-direction, similar to the ridges 15 of the lower surface 12*b* of the plate like portion 12. By the provision of the material-depressed portions 16 on the upper surface 12*a* of the plate like portion 12, similar waves are formed in the upper and the lower surfaces 12*a,* 12*b,* as shown in FIG. 16, so that the difference between expansion/contraction coefficients on the upper and the lower surfaces 12*a,* 12*b* of the plate like portion 12 can be made as small as possible. Therefore, according to the present embodiment, the undesirable curves can be reduced.

Various modifications and embodiments will be described hereinbelow with reference to FIGS. 17–42. However, similar ground plate 20, similar signal contact pins 25, and similar shell 30 can be used and combined with the insulator in the similar manner as described with reference to FIGS. 1–16. Accordingly, description of them will be omitted for the simplification of the description and the drawings.

Figure 17:
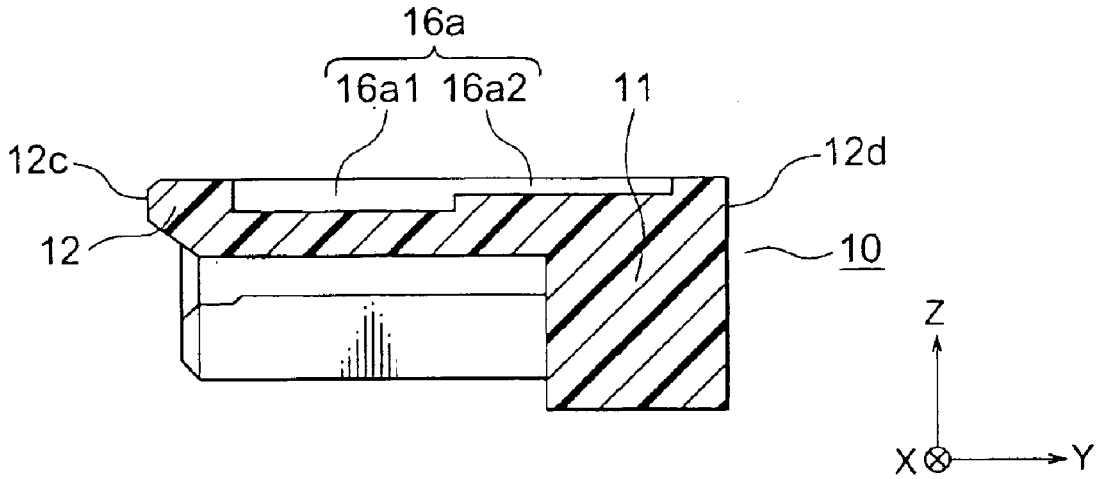
FIG. 17 is a cross-sectional view showing a modification of the insulator of FIG. 15.

The material-depressed portions 16 may be modified as material-depressed portions 16*a,* as shown in FIG. 17. The illustrated material-depressed portion 16*a* is comprised of two sections 16*a*1, 16*a*2. The sections 16*a*1, 16*a*2 constituting one material-depressed portion 16*a* are arranged on a single imaginary line extending in the Y-direction. The section 16*a*1 has a depth different from another depth of the second 16*a*2. Specifically, the section 16*a*1 nearer to the front edge 12*c* of the plate like portion 12 is deeper than the section 16*a*2 nearer to the rear edge 12*d* of the plate like portion 12. In other words, the material-depressed portion 16*a* has stepwise-increased depths towards the front edge 12*c* to the plate like portion 12. The material-depressed portion 16*a* may have a continuously-increased depth towards the front edge 12*c* of the plate like portion 12.

Figure 18:
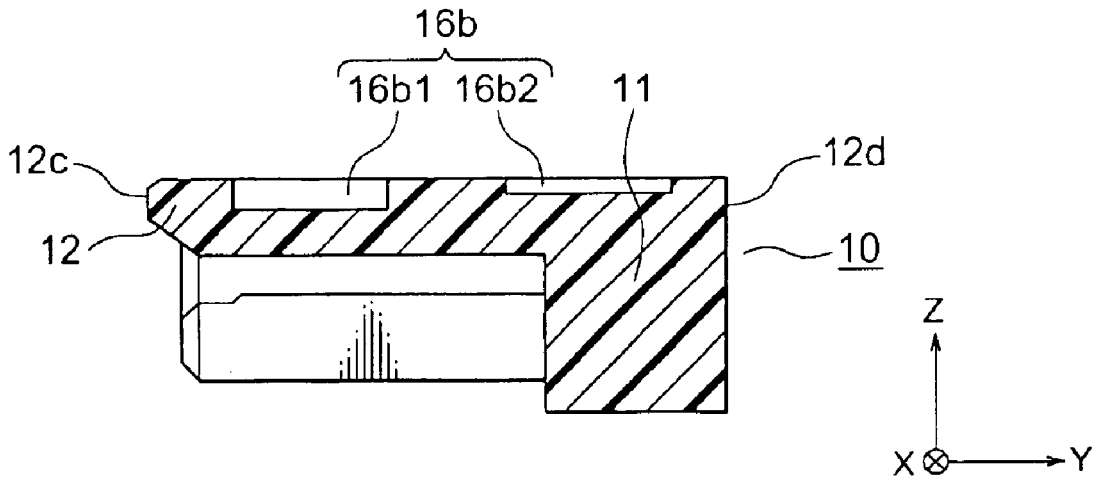
FIG. 18 is a cross-sectional view showing another modification of the insulator of FIG. 15.

The material-depressed portions 16 further may be modified as material-depressed portions 16*b,* as shown in FIG. 18. The illustrated material-depressed portion 16*b* is comprised of two sections 16*b*1, 16*b*2. Similar to the material-depressed portion 16*a* of FIG. 17, the sections 16*b*1, 16*b*2 constituting one material-depressed portion 16*b* are arranged on a single imaginary line extending in the Y-direction. In addition, the section 16*b*1 is separated and spaced from the section 16*b*2 in the Y-direction. The section 16*b*1 has a depth different from another depth of the second 16*b*2. The section 16*b*1 has a constant depth, while the section 16*b*2 has another constant depth. Each section 16*b*1, 16*b*2 may have stepwise-increased depths towards the front edge 12*c* of the plate like portion 12, or may have a continuously-increased depth towards the front edge 12*c* of the plate like portion 12.

Figure 19:
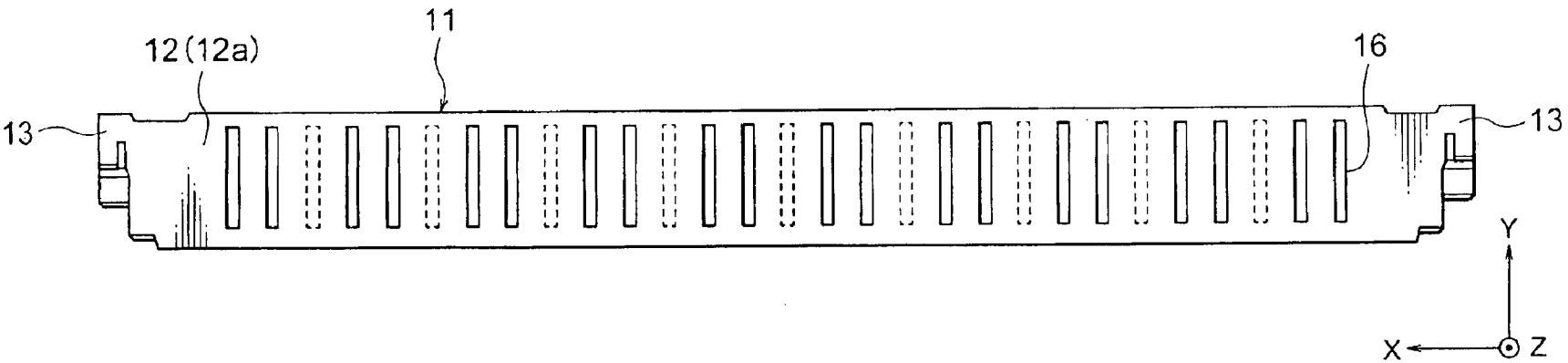
FIG. 19 is a top plan view showing another modification of the insulator of FIG. 12.
Figure 20:
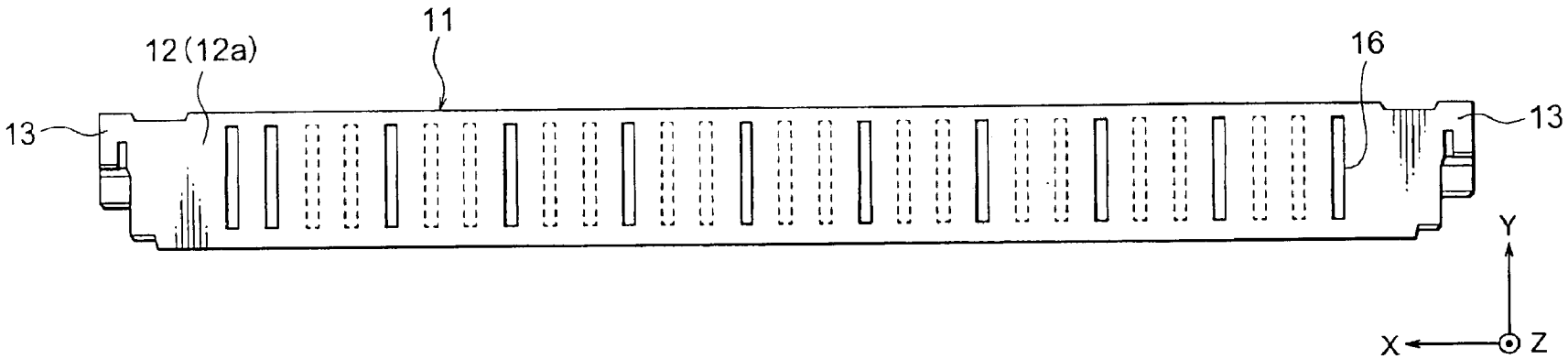
FIG. 20 is a top plan view showing another modification of the insulator of FIG. 12.
Figure 21:
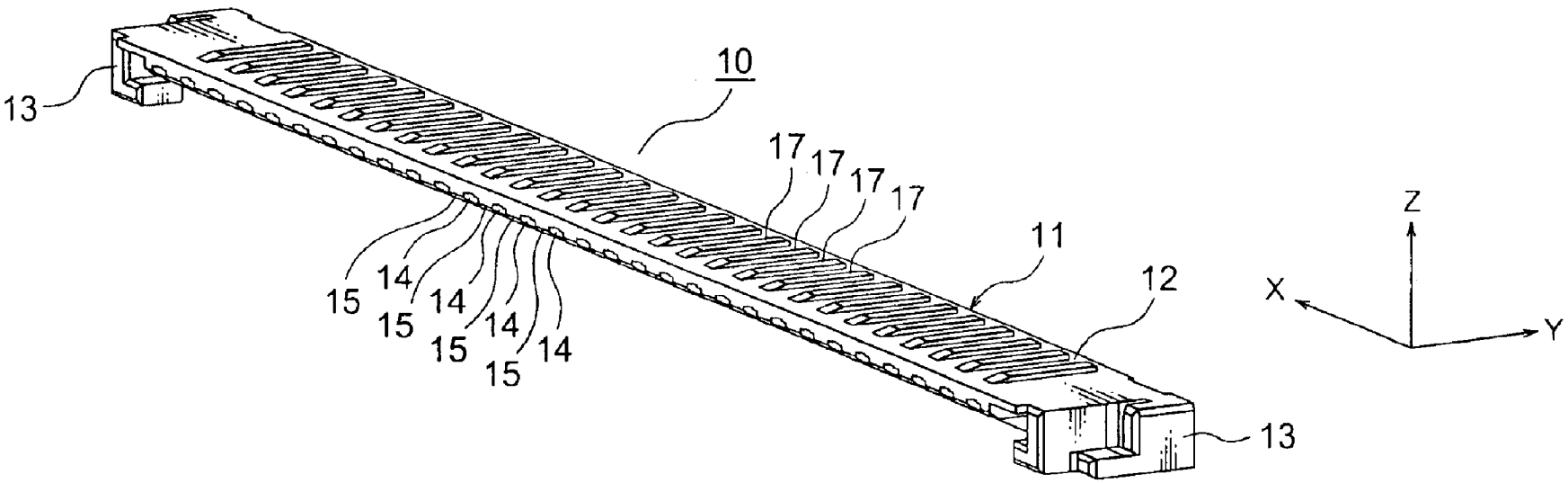
FIG. 21 is a perspective view showing an insulator according to a second embodiment of the present invention.

As seen from FIG. 12 and FIG. 19 or 16, the material-depressed portions 16 may be formed in the upper surface 12*a* of the plate like portion 12 so that the material-depressed portions 16 correspond not to all of the ridges but to the regularly-selected ones of the ridges of the lower surface of the plate like portion 12. The decreased material-depressed portions 16 in comparison with FIG. 12 are shown with broken lines in FIG. 19 or 16. In the insulator shown in FIG. 19, one material-depressed portion is decreased for each three material-depressed portions 16 of FIG. 12. In the insulator shown in FIG. 20, two material-depressed portions are decreased for each three material-depressed portions 16 of FIG. 12.

With reference to FIGS. 21 to 26, an insulator according to a second embodiment of the present invention has a similar structure to the first embodiment. Only the differences between the first and the second embodiments will be explained below.

As shown in FIGS. 21, 22, and 24 to 26, the insulator 10 according to the second embodiment comprises a plurality of material-raised portions 17 instead of the material-depressed portions 16 of the first embodiment. Each of the material-raised portions 17 extends and is elongated in the Y-direction and has a cross-section shaped like the Inter City Express or the Shinkansen, wherein the cross-section is comprised of two parts: a slantingly-rising part $\mathbf{17}_1$ and a constant part $\mathbf{17}_2$ continuing from the slantingly-rising part $\mathbf{17}_1$. The slantingly-rising part $\mathbf{17}_1$ is positioned nearer to the front edge 12*c* of the plate like portion 12 than the constant part $\mathbf{17}_2$ in the Y-direction. Each of the material-raised portions 17 generally has a shape longer in the Y-direction than in the X-direction. In this embodiment, each of the material-raised portions 16 does not reach front and rear edges 12*c,* 12*d* of the plate like portion 12 in the Y-direction.

Figure 25:
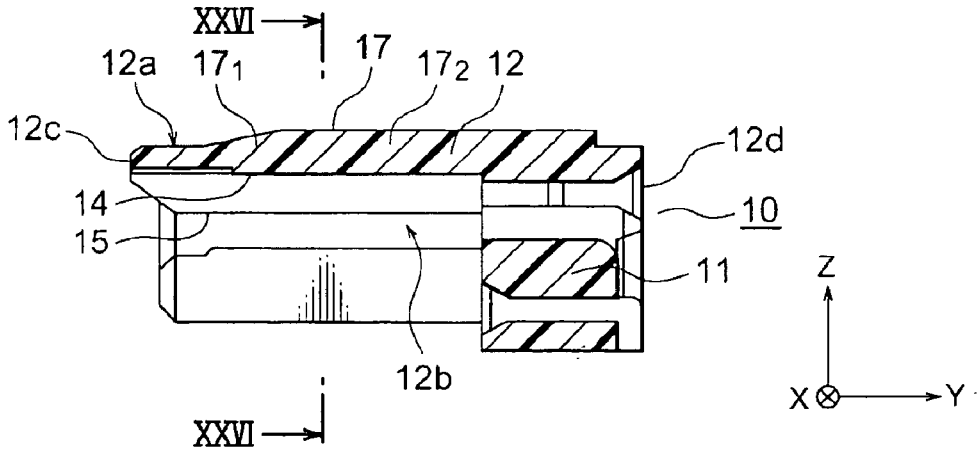
FIG. 25 is a cross-sectional view showing the insulator of FIG. 22 or 23, taken along lines XXV—XXV.
Figure 26:
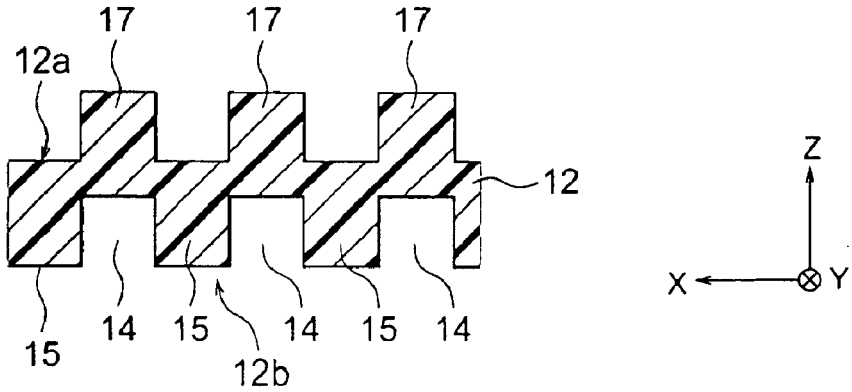
FIG. 26 is a cross-sectional view schematically showing a plate like portion of the insulator of FIG. 25, taken along lines XXVI—XXVI.

The material-raised portions 17 are positioned in correspondence with the respective grooves 14, as best shown in FIGS. 25 and 26. The material-raised portions 17 are arranged in the X-direction, similar to the grooves 14 of the lower surface 12*b* of the plate like portion 12. By the provision of the material-raised portions 17 on the upper surface 12*a* of the plate like portion 12, similar waves are formed in the upper and the lower surfaces 12*a,* 12*b,* as shown in FIG. 26, so that the present embodiment can provide the same effect as the first embodiment.

Figure 27:
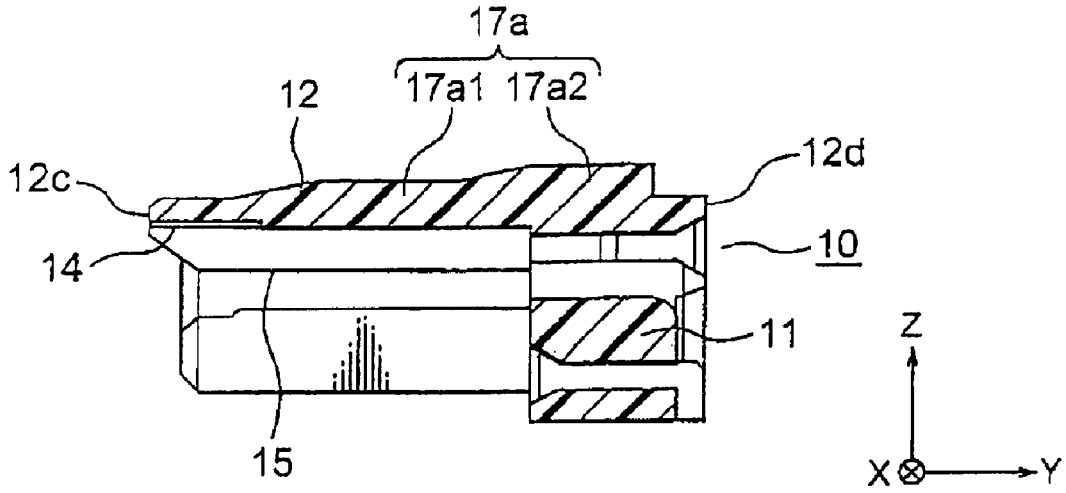
FIG. 27 is a cross-sectional view showing a modification of the insulator of FIG. 25.

The material-raised portions 17 may be modified as material-raised portions 17*a,* as shown in FIG. 27. The illustrated material-raised portion 17*a* is comprised of two sections 17*a*1, 17*a*2. The sections 17*a*1, 17*a*2 constituting one material-raised portion 17*a* are arranged on a single imaginary line extending in the Y-direction. Each of the sections 17*a*1, 17*a*2 has a similar cross section to the material-raised portion 17. However, the section 17*a*1 has a height different from another height of the second 17*a*2. Specifically, the section 17*a*1 nearer to the front edge 12*c* of the plate like portion 12 is lower than the section 17*a*2 nearer to the rear edge 12*d* of the plate like portion 12. The material-raised portion 17*a* may have a continuously-decreased height towards the front edge 12*c* of the plate like portion 12.

Figure 28:
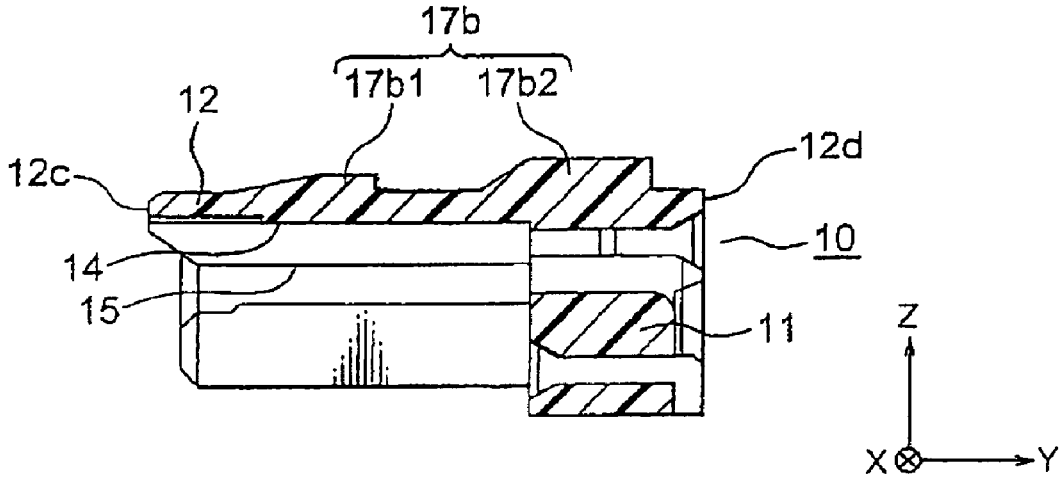
FIG. 28 is a cross-sectional view showing another modification of the insulator of FIG. 25.

The material-raised portions 17 further may be modified as material-raised portions 17*b,* as shown in FIG. 28. The illustrated material-depressed portion 17*b* is comprised of two sections 17*b*1, 17*b*2. Similar to the material-raised portion 17*a* of FIG. 27, the sections 17*b*1, 17*b*2 constituting one material-depressed portion 17*b* are arranged on a single imaginary line extending in the Y-direction. In addition, the section 17*b*1 is separated and spaced from the section 17*b*2 in the Y-direction. The section 17*b*1 has a height lower than another height of the second 17*b*2.

Figure 22:
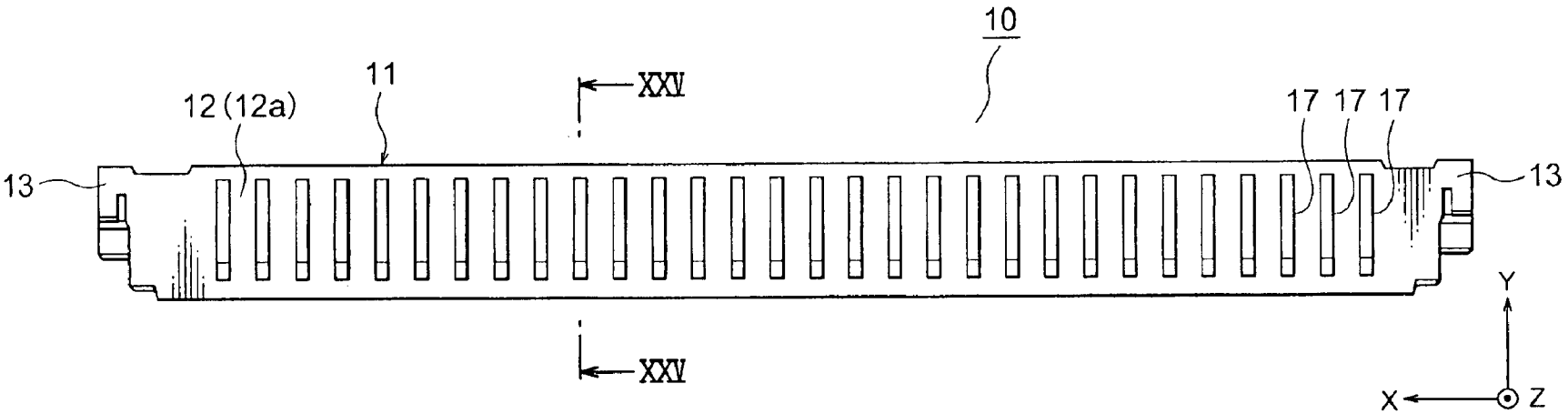
FIG. 22 is a top plan view showing the insulator of FIG. 21.
Figure 23:
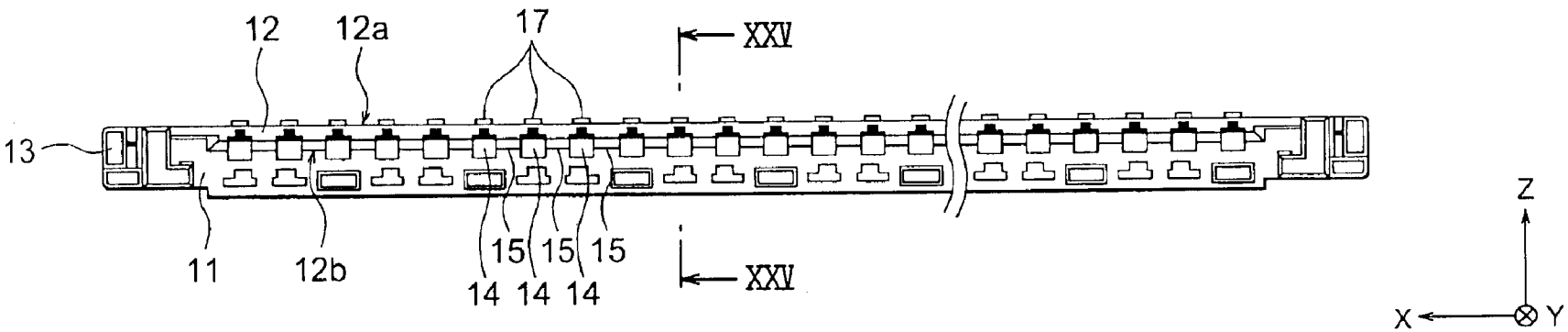
FIG. 23 is a front view showing the insulator of FIG. 21.
Figure 24:
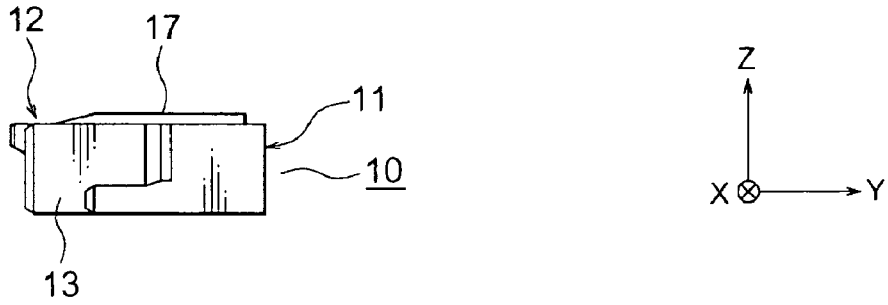
FIG. 24 is a side view showing the insulator of FIG. 21.
Figure 29:
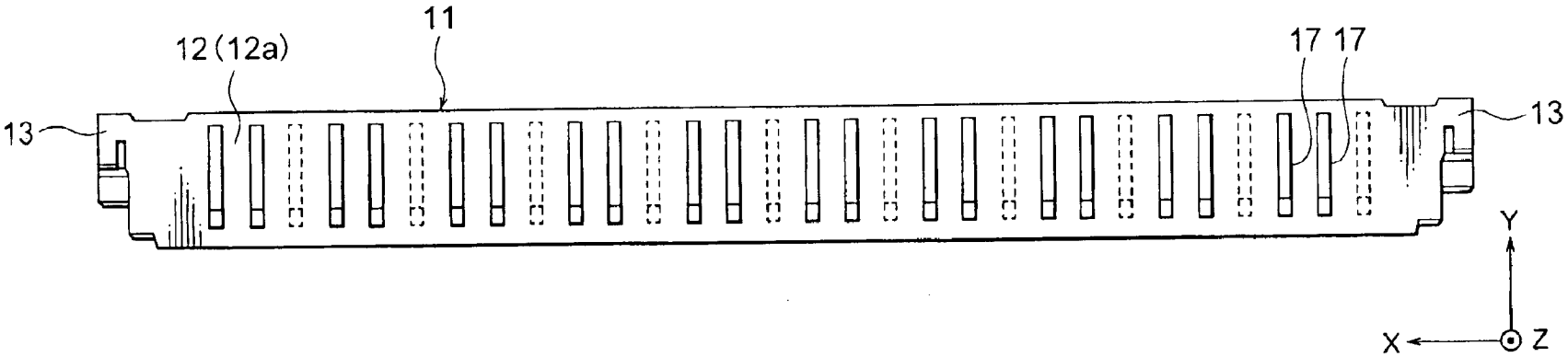
FIG. 29 is a top plan view showing another modification of the insulator of FIG. 22.
Figure 30:
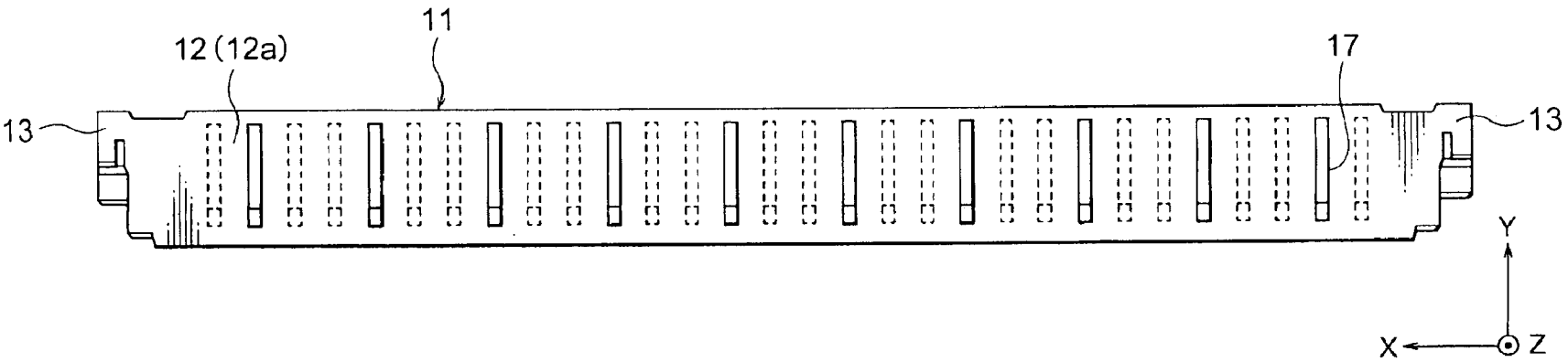
FIG. 30 is a top plan view showing another modification of the insulator of FIG. 22.
Figure 31:
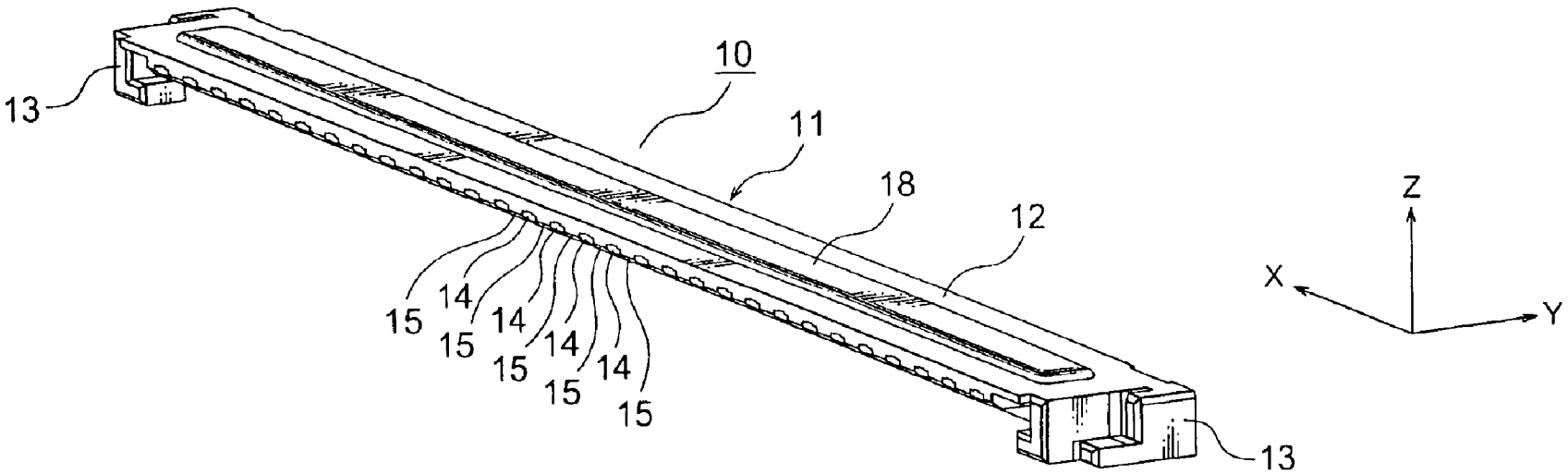
FIG. 31 is a perspective view showing an insulator according to a third embodiment of the present invention.
Figure 32:
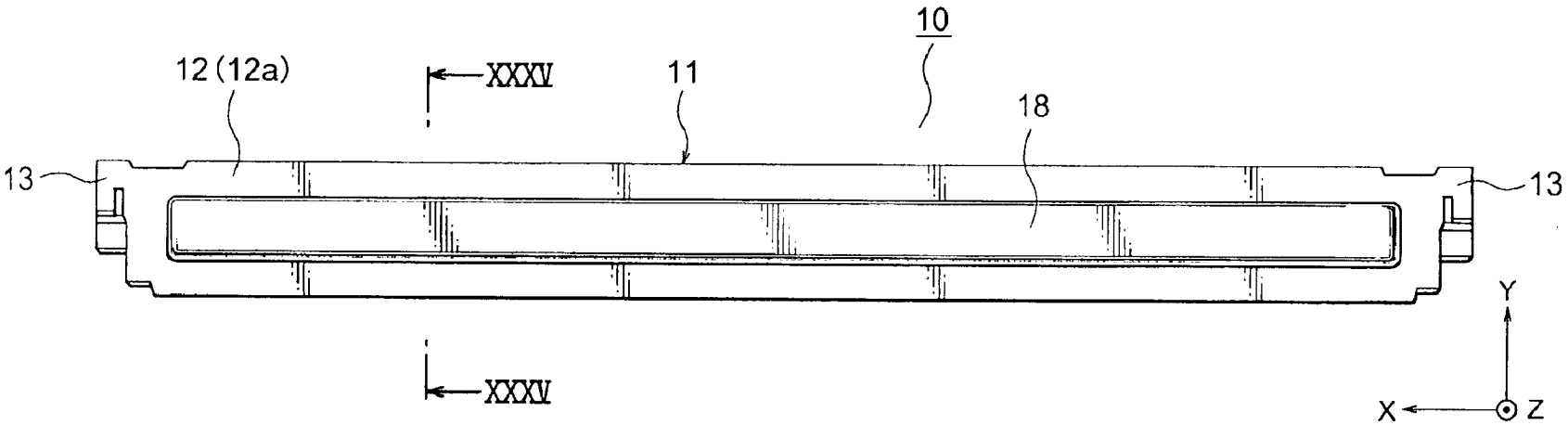
FIG. 32 is a top plan view showing the insulator of FIG. 31.
Figure 33:
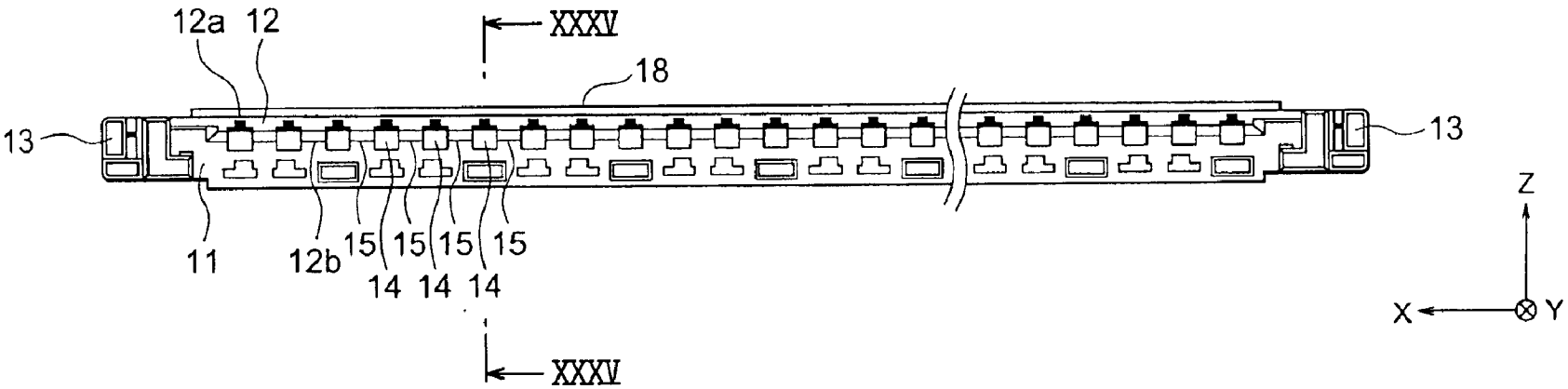
FIG. 33 is a front view showing the insulator of FIG. 31.
Figure 34:
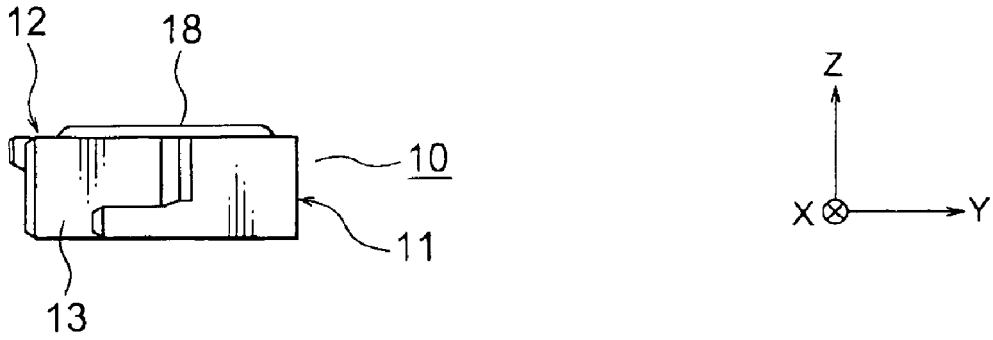
FIG. 34 is a side view showing the insulator of FIG. 31.
Figure 35:
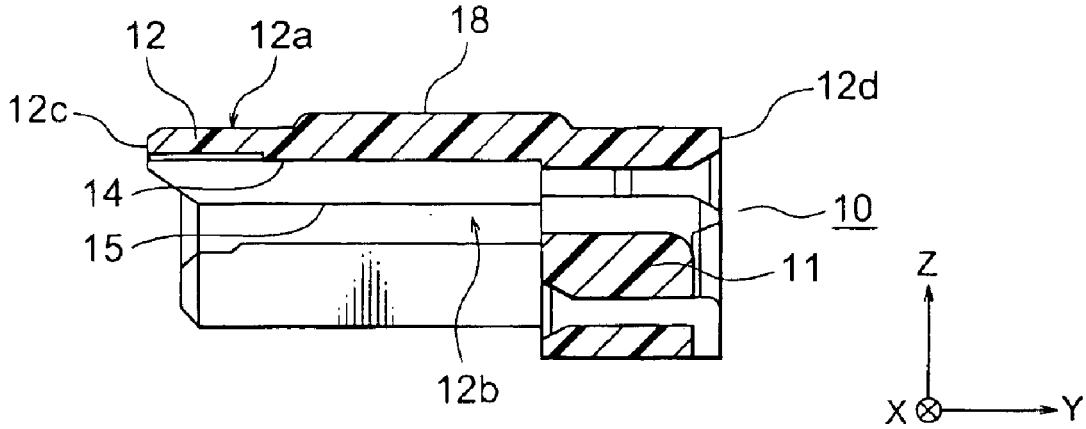
FIG. 35 is a cross-sectional view showing the insulator of FIG. 32 or 33, taken along lines XXXV—XXXV.

As seen from FIG. 22 and FIG. 29 or 26, the material-raised portions 17 may be formed in the upper surface 12*a* of the plate like portion 12 so that the material-raised portions 17 correspond not to all of the grooves but to the regularly-selected ones of the grooves of the lower surface of the plate like portion 12. The decreased material-raised portions 17 in comparison with FIG. 22 are shown with broken lines in FIG. 29 or 26. In the insulator shown in FIG. 29, one material-raised portion is decreased for each three material-raised portions 17 of FIG. 22. In the insulator shown in FIG. 30, two material-raised portions are decreased for each three material-raised portions 17 of FIG. 22.

The plate like portion 12 of the insulator 10 may have the material-depressed portions 16 according to the first embodiment and the material-raised portions 17 according to the second embodiment. That is, the first embodiment may be conceptually combined with the second embodiment.

With reference to FIGS. 31 to 35, a third embodiment of the present invention adopts an alternative approach to the first and the second embodiments, so as to suppress the occurrence of the undesirable curves. In this embodiment, the resin is flowed into a metal mold along the X-direction when the insulator 10 elongated in the X-direction is manufactured. If a material-increased portion 18 extending in the X-direction (i.e. a resin-flowing direction) is provided for the plate like portion 12, it becomes easy for resin to flow into a metal mold smoothly upon injection molding. As a result, residual stress is reduced so that the occurrence of the undesirable curves is suppressed.

The illustrated material-increased portion 18 is a single portion which is laid over all of the grooves 14 and the ridges 15 in the X-direction. The material-increased portion 18 is formed on the upper surface 12*a* of the plate like portion 12 of the insulator 10. The material-increased portion 18 has a thin, rectangular shape which is elongated in the X-direction. The material-increased portion 18 does not reach the front and the rear edges 12*c*, 12*d* of the plate like portion 12 in the Y-direction.

Figure 36:
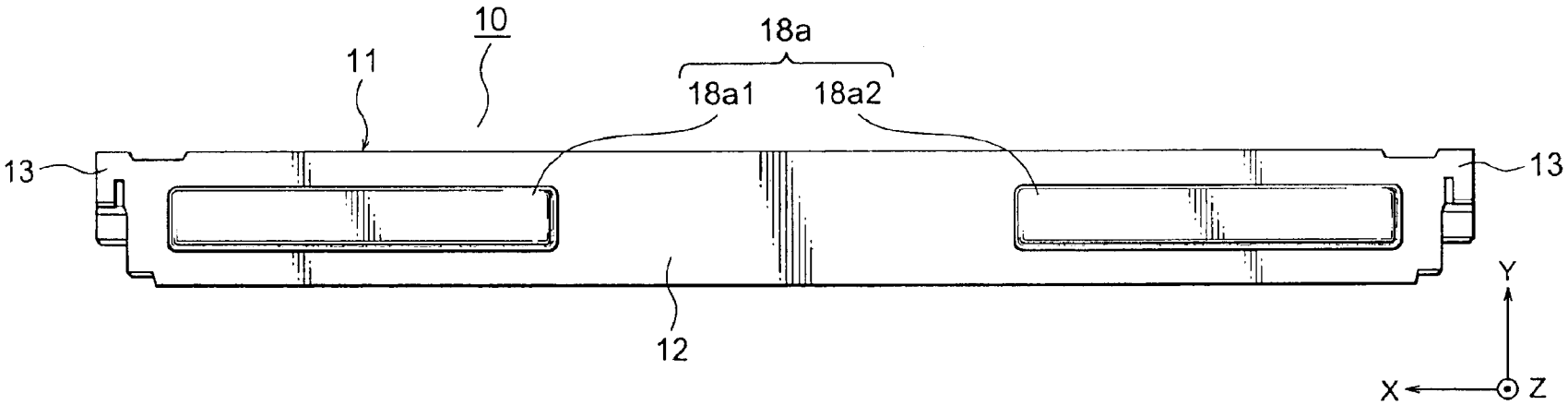
FIG. 36 is a top plan view showing a modification of the insulator of FIG. 32.
Figure 37:
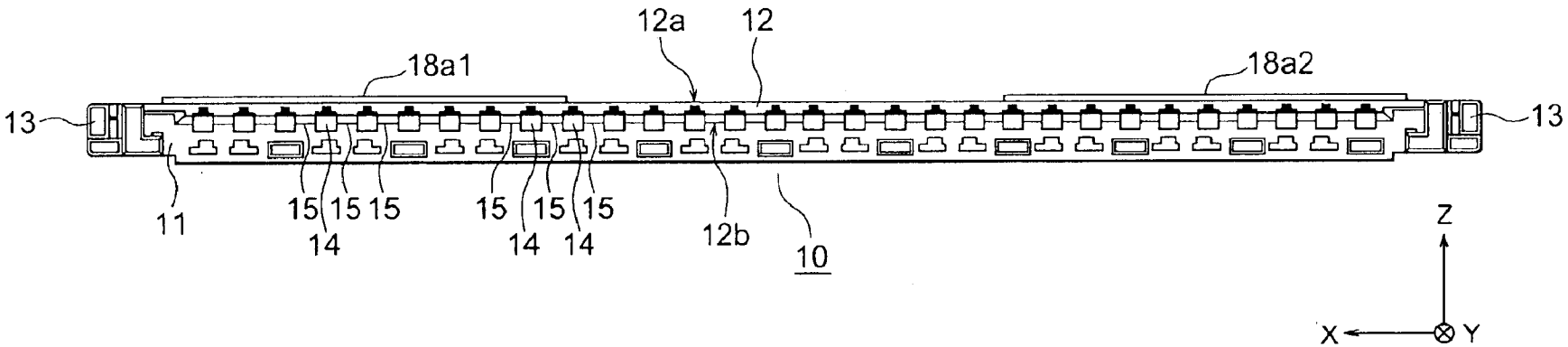
FIG. 37 is a front view showing the insulator of FIG. 36.

The single integrally-formed material-increased portion 18 may be modified as a material-increased portion 18*a*, as shown in FIGS. 36 and 37. The material-increased portion 18*a* is comprised of two sections 18*a*1, 18*a*2. Each of the sections 18*a*1, 18*a*2 is elongated in the X-direction so that the section 18*a*1, 18*a*2 has a shape longer in the X-direction than in the Y-direction. The sections 18*a*1, 18*a*2 are arranged in the X-direction and are spaced from each other in the X-direction.

Figure 38:
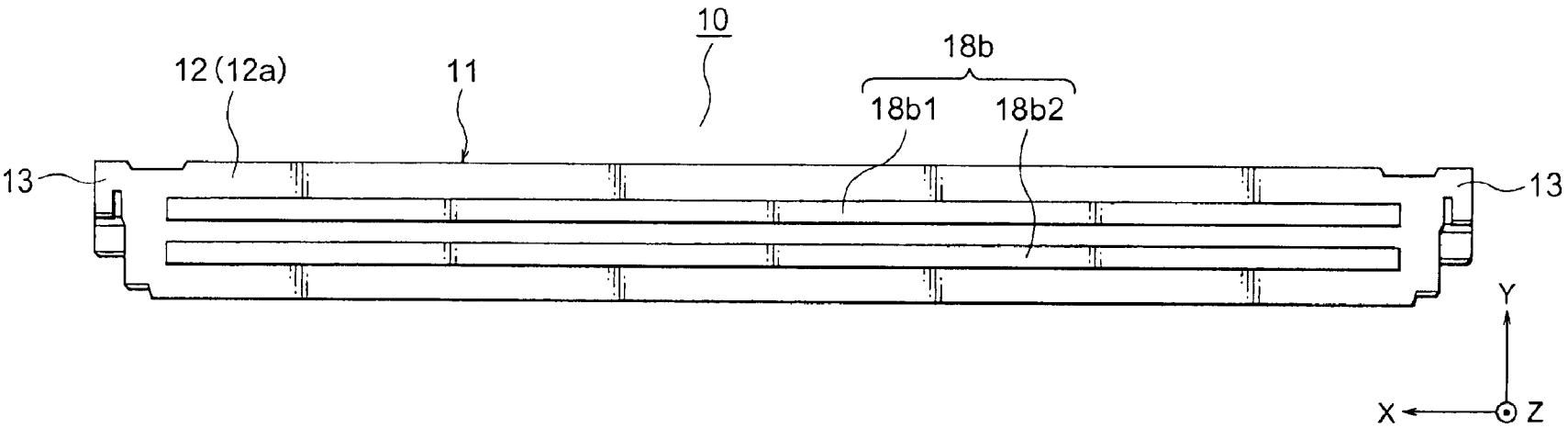
FIG. 38 is a top plan view showing another modification of the insulator of FIG. 32.

Also, the material-increased portion 18 may be modified as a material-increased portion 18*b*, as shown in FIG. 38. The material-increased portion 18*b* is comprised of two sections 18*b*1, 18*b*2. Each of the sections 18*b*1, 18*b*2 is elongated in the X-direction so that the section 18*b*1, 18*b*2 has a shape longer in the X-direction than in the Y-direction. The sections 18*b*1, 18*b*2 are arranged not in the X-direction but in the Y-direction so that the sections 18*b*1, 18*b*2 are spaced from each other in the Y-direction.

Figure 39:
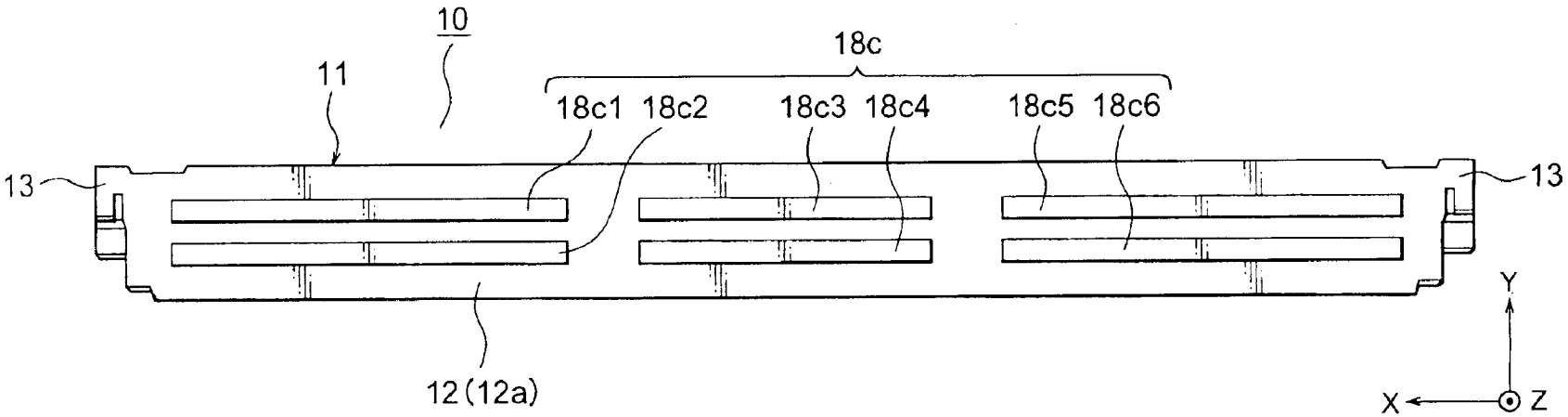
FIG. 39 is a top plan view showing another modification of the insulator of FIG. 32.

Furthermore, the material-increased portion 18 may be modified as a material-increased portion 18*c*, as shown in FIG. 39. The material-increased portion 18*c* is comprised of six sections 18*c*1 to 18*c*6. Each of the sections 18*c*1 to 18*c*6 is elongated in the X-direction so that it has a shape longer in the X-direction than in the Y-direction. The sections 18*c*1, 18*c*2 are arranged in the Y-direction. The sections 18*c*3, 18*c*4 are also arranged in the Y-direction. The sections 18*c*5, 18*c*6 are alto arranged in the Y-direction. The sections 18*c*1, 18*c*3, 18*c*5 are arranged in the X-direction. Likewise, the sections 18*c*2, 18*c*4, 18*c*6 are arranged in the X-direction. The sections 18*c*1 to 18*c*6 are separated from each other in accordance with the arrangements thereof.

Figure 40:
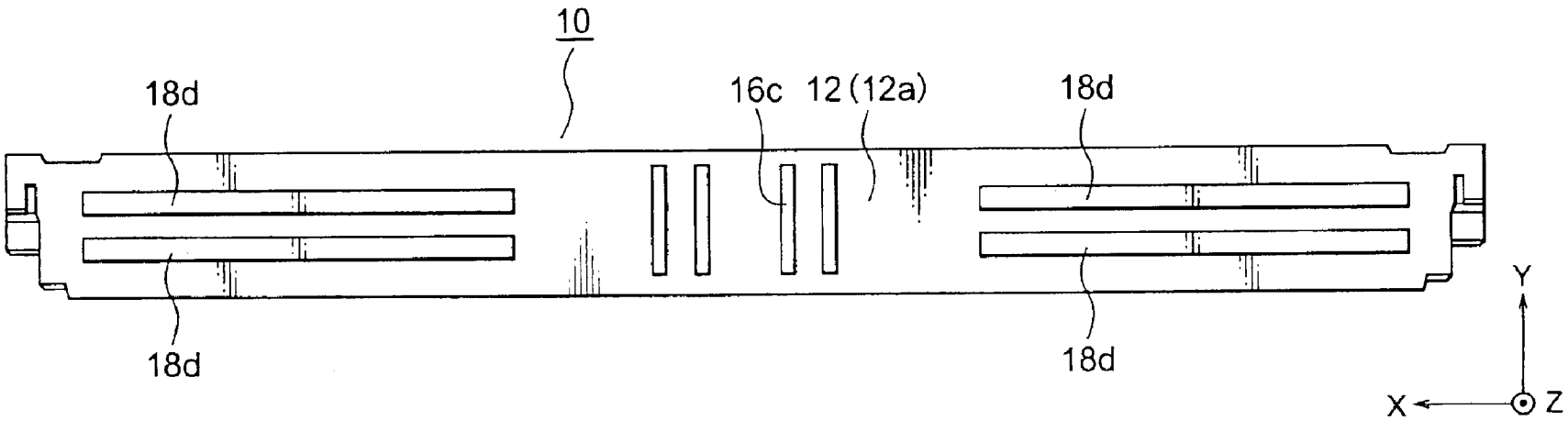
FIG. 40 is a top plan view showing an insulator according to a fourth embodiment of the present invention.
Figure 41:
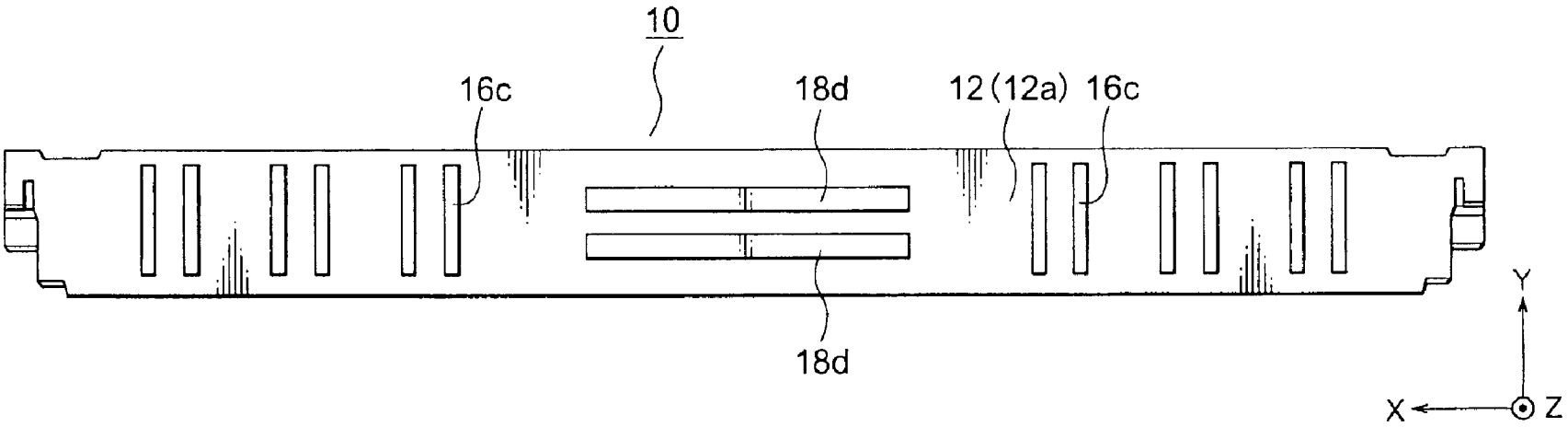
FIG. 41 is a top plan view showing a modification of the insulator of FIG. 40.
Figure 42:
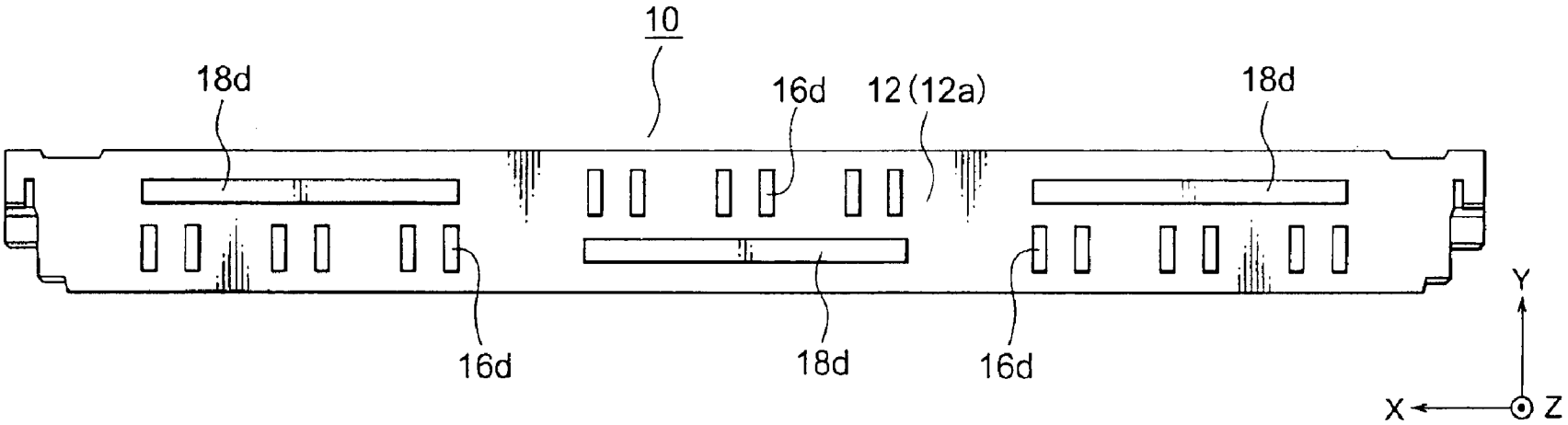
FIG. 42 is a top plan view showing another modification of the insulator of FIG. 40.

The plate like portion 12 of the insulator 10 may have the material-depressed portions 16 according to the first embodiment and the material-increased portions 18 according to the third embodiment. That is, the first embodiment may be conceptually combined with the third embodiment. FIGS. 40 to 42 show various combinations of the first and the third embodiments.

The insulator 10 shown in FIG. 40 is provided with four material-depressed portions 16*c* and two pairs of material-increased portions 18*d*. The material-increased portions 18*d* are formed on the upper surface 12*a* of the plate like portion 12. The material-depressed portions 16*c* are formed in the upper surface 12*a* of the plate like portion 12. Each of the material-increased portions 18*d* is elongated in the X-direction, while each of the material-depressed portions 16*c* is elongated in the Y-direction. All of the material-depressed portions 16*c* are positioned between the pairs of the material-increased portions 18*d* in the X-direction.

The insulator 10 shown in FIG. 41 is provided with two sets of six material-depressed portions 16*c* and two material-increased portions 18*d*. The material-increased portions 18*d* are formed on the upper surface 12*a* of the plate like portion 12. All of the material-increased portions 18*d* are positioned between the sets of the material-depressed portions 16*c* in the X-direction.

The insulator 10 shown in FIG. 42 is provided with three sets of a material-increased portion 18*d* and six material-depressed portions 16*d*. Each of the material-depressed portions 16*d* is elongated in the Y-direction. The opposite sets of the material-increased portion 18*d* and the material-depressed portions 16*d* have the same arrangements as each other. The middle set of the material-increased portion 18*d* and the material-depressed portions 16*d* has the reverse arrangement of the opposite sets. That is, on the upper surface 12*a* of the plate like portion shown in FIG. 42, a plurality of sets are arranged in alternate arrangements, wherein each of the sets comprises the material-increased portion(s) 18*d* and a plurality of the material-depressed portions 16*d*.

What is claimed is:

1. A receptacle connector mounted on a circuit board, said receptacle connector comprising an insulator and a plurality of contact pins held by the insulator, wherein the insulator comprises a base portion elongated in a first direction (X) and having a thickness in a second direction (Y) perpendicular to the first direction (X) and a height in a third direction (Z) perpendicular to the first and second directions, (X, Y), the insulator further comprises a plate like portion, the plate like portion extending in the second direction (Y) from a top end of the base portion in the third direction (Z) and having lower and upper surfaces opposite to each other in the third direction (Z), the plate like portion having a plurality of grooves formed in the lower surface, the grooves extending in parallel with each other in the second direction (Y) and being spaced from each other in the first direction (X) so that a plurality of ridges are formed between the respective neighboring ones of the grooves in the first direction (X), and wherein the contact pins are supported by the base portion and extend in the second direction (Y) along the grooves, respectively, characterized in that the insulator is provided with a pattern on the upper surface, the pattern comprises a plurality of depressed portions formed on the upper surface and/or a plurality of raised portions formed on the upper surface, wherein the insulator is made of anisotropic resin, wherein each of the depressed portions extends in the second direction (Y) and having an extent longer in the second direction (Y) than in the first direction (X), and wherein each of the raised portions extends in the second direction (Y) and has an extent longer in the second direction (Y) than in the first direction (X), wherein each of the depressed portions is positioned in correspondence with any one of the ridges, or wherein each of the raised portions is positioned in correspondence with any one of the grooves, or both.

2. The connector receptacle connector according to claim 1, wherein the insulator is made of liquid crystal polymer.

3. The receptacle connector according to claim 1, wherein each of the depressed portions is comprised of two or more sections, which are arranged on one imaginary line extending in the second direction (Y).

4. The receptacle connector according to claim 1, wherein each of the raised portions is comprised of two or more sections, which are arranged on one imaginary line extending in the second direction (Y).

5. The receptacle connector according to claim 1, wherein the insulator further comprises two side blocks joined to the base portion and the plate like portion at opposite ends thereof in the first direction (X), and the insulator is covered with a tubular metallic shell, the metallic shell comprising a top portion overlying the upper surface of the plate like portion, opposite side portions overlying outer surfaces of the opposite two side blocks, and a lower portion extending between the two opposite side blocks in the first direction (X) and facing the lower surface of the plate like portion spaced from the lower surface and the contact pins in the third direction (Z).

6. The receptacle connector according to claim 3, wherein the sections constituting one depressed portion have different depths from each other.

7. The receptacle connector according to claim 4, wherein the sections constituting one raised portion have different heights from each other.

8. The receptacle connector according to claim 3, wherein the sections constituting one depressed portion are separated from each other in the second direction (Y).

9. The receptacle connector according to claim 4, wherein the sections constituting one raised portion are separated from each other in the second direction (Y).

10. The receptacle connector according to claim 5, which further comprises a ground plate, which comprises a plate portion extending in the first direction (X) and being held in the base portion, and ground contact pins extending from the plate portion in the second direction (Y) along the lower portion of the metallic shell, the ground contact pins being spaced from the contact pins in the third direction (Z).

11. A receptacle connector mounted on a circuit board, said receptacle connector comprising an insulator and a plurality of contact pins held by the insulator, wherein the insulator comprises a base portion elongated in a first direction (X) and having a thickness in a second direction (Y) perpendicular to the first direction (X) and a height in a third direction (Z) perpendicular to the first and second directions (X, Y), the insulator further comprises a plate like portion, the plate like portion extending in the second direction (Y) from a top end of the base portion in the third direction (Z) and having lower and upper surfaces opposite to each other in the third direction (Z), the plate like portion having a plurality of grooves formed in the lower surface, the grooves extending parallel to each other in the second direction (Y) and being spaced from each other in the first direction (X) so that a plurality of ridges are formed between the respective neighboring ones of the grooves in the first direction (X), and wherein the contact pins are supported by the base portion and extend in the second direction (Y) along the grooves, respectively, characterized in that the insulator is provided with a pattern on the upper surface, wherein the pattern comprises at least one raised portion extending in the first direction (X), the raised portion having an extent longer in the first direction (X) than in the second direction (Y), wherein the insulator is made of anisotropic resin.

12. The receptacle connector according to claim 11, wherein a plurality of raised portions are arranged in the first direction (X), and/or arranged in the second direction (Y).

13. The receptacle connector according to claim 12, wherein the plurality of raised portions are separated from each other in the first and/or the second directions (X, Y).

14. The receptacle connector according to claim 11, which further comprises depressed portions in the upper surface, each of the depressed portions extending in the second direction (Y) without intersecting with the raised portions.

* * * * *